US012207706B2

(12) United States Patent
Chen

(10) Patent No.: US 12,207,706 B2
(45) Date of Patent: Jan. 28, 2025

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 50 days.

(21) Appl. No.: 17/342,494

(22) Filed: Jun. 8, 2021

(65) Prior Publication Data

US 2021/0289889 A1 Sep. 23, 2021

Related U.S. Application Data

(63) Continuation-in-part of application No. 17/271,602, filed as application No. PCT/CN2019/095132 on Jul. 8, 2019, now Pat. No. 11,805,856.

(30) Foreign Application Priority Data

Oct. 30, 2018 (CN) ..... 201811275429.6

(51) Int. Cl.
*A43C 11/16* (2006.01)
*B65H 75/48* (2006.01)

(52) U.S. Cl.
CPC ..... *A43C 11/165* (2013.01); *B65H 75/48* (2013.01); *B65H 2701/35* (2013.01)

(58) Field of Classification Search
CPC ..... A43C 11/20; A43C 11/165; A43C 11/00; A43C 11/16; A43C 7/00; Y10T 24/2183; Y10T 24/37; B65H 75/48; B65H 2701/35
See application file for complete search history.

(56) References Cited

U.S. PATENT DOCUMENTS

| | | | | |
|---|---|---|---|---|
| 6,015,110 | A * | 1/2000 | Lai | H02G 11/02 242/396.9 |
| 8,468,657 | B2 * | 6/2013 | Soderberg | A43C 1/06 242/395 |
| 8,516,662 | B2 * | 8/2013 | Goodman | B65H 75/4431 36/50.5 |
| 9,364,054 | B2 * | 6/2016 | Gittens | A43C 1/06 |
| 9,770,070 | B2 * | 9/2017 | Cotterman | A43C 11/20 |
| 2007/0084956 | A1 | 4/2007 | Chen | |
| 2010/0270413 | A1 | 10/2010 | Chien | |
| 2012/0228419 | A1 | 9/2012 | Chen | |

(Continued)

FOREIGN PATENT DOCUMENTS

| | | | |
|---|---|---|---|
| CN | 1074357 | A | 7/1993 |
| CN | 1657388 | A | 8/2005 |

(Continued)

*Primary Examiner* — Robert Sandy
*Assistant Examiner* — Rowland Do
(74) *Attorney, Agent, or Firm* — CKC & Partners Co., LLC

(57) ABSTRACT

A fastening device includes a case unit, a spool, a driving unit, a knob and a connecting unit. The case unit includes an annular wall surrounding an inner space, and a base detachably and directly coupled to the annular wall. The spool is located within the inner space. The driving unit is located within the inner space and selectively prohibits the spool from rotating in a loosening direction. The knob is disposed on the annular wall. The connecting unit is connected to at least one of the knob, the spool and the driving unit without passing through the base and restricted by at least one of the annular wall, the spool and the driving unit such that the annular wall, the spool, the driving unit and the knob are combined integrally.

4 Claims, 45 Drawing Sheets

(56) References Cited

U.S. PATENT DOCUMENTS

| | | | | |
|---|---|---|---|---|
| 2013/0025100 | A1* | 1/2013 | Ha | A43C 11/165 24/712.9 |
| 2014/0359981 | A1* | 12/2014 | Cotterman | A43C 11/20 24/712.9 |
| 2015/0007422 | A1* | 1/2015 | Cavanagh | A43C 11/165 29/434 |
| 2015/0230560 | A1* | 8/2015 | Chen | A43C 7/02 24/68 SK |
| 2016/0058130 | A1 | 3/2016 | Boney et al. | |
| 2017/0042289 | A1* | 2/2017 | Ha | A44B 99/00 |
| 2017/0295888 | A1* | 10/2017 | Chen | A43C 11/165 |
| 2017/0303643 | A1* | 10/2017 | Converse | A61C 7/026 |
| 2017/0325548 | A1* | 11/2017 | Ha | A43C 11/165 |
| 2020/0337418 | A1* | 10/2020 | Chen | B65H 75/4494 |
| 2020/0346888 | A1 | 11/2020 | Kruse et al. | |

FOREIGN PATENT DOCUMENTS

| | | | | |
|---|---|---|---|---|
| CN | 201015448 | Y | 2/2008 | |
| CN | 201718602 | U | 1/2011 | |
| CN | 203492894 | U | 3/2014 | |
| CN | 104906720 | A | 9/2015 | |
| CN | 204895922 | U | 12/2015 | |
| CN | 204969764 | U | 1/2016 | |
| CN | 206187398 | U | 5/2017 | |
| CN | 206499022 | U | 9/2017 | |
| CN | 206565397 | U | 10/2017 | |
| CN | 207061543 | U | 3/2018 | |
| CN | 111115388 | A | 5/2020 | |
| CN | 111115389 | A | 5/2020 | |
| CN | 111846339 | A | 10/2020 | |
| DE | 202016104318 | U1 | 11/2016 | |
| EP | 2269479 | A1 | 1/2011 | |
| JP | H07208 | A | 1/1995 | |
| JP | 3159620 | U | 5/2010 | |
| JP | 3202821 | U | 2/2016 | |
| JP | 2017513679 | A | 6/2017 | |
| KR | 1020160131296 | A | 11/2016 | |
| KR | 101862571 | B1 | 5/2018 | |
| TW | 201517828 | A | 5/2015 | |
| TW | M507670 | U | 9/2015 | |
| WO | 2011081261 | A1 | 7/2011 | |
| WO | 2014001918 | A2 | 1/2014 | |
| WO | WO-2015035885 | A1 * | 3/2015 | A43C 11/165 |
| WO | 2017/107724 | A1 | 6/2017 | |
| WO | 2017126876 | A1 | 7/2017 | |
| WO | 2017175586 | A1 | 10/2017 | |
| WO | 2018086068 | A1 | 5/2018 | |

* cited by examiner

100

100d

100e

100f

100f

100g

100g

100g

100h

100k

100k

100n

100p

100p

100r

100r

100q

100t

100s

500u

400u

FASTENING DEVICE

RELATED APPLICATIONS

This application is a Continuation-in-part of U.S. application Ser. No. 17/271,602, filed on Feb. 26, 2021, which is a continuation of International application PCT/CN2019/095132 filed on Jul. 8, 2019 which claims the benefits of priority of China application No. 201811275429.6 filed on Oct. 30, 2018, the content of which are incorporated herein by reference.

BACKGROUND

Technical Field

The present disclosure relates to a fastening device. More particularly, the present disclosure relates to a fastening device for securing an article through loosening or tightening a lace.

Description of Related Art

In daily life, cords, such as a lace or a thread, are usually used to tighten articles. The most common tightening method is to use the cord to reciprocately pass through holes on the article, such as eyelets of a shoe, and then tie a knot to secure the article. But in this kind of tightening method, the knot is loosened easily because of an external force. Not only does the knot need to be tied again, but also lots of inconveniences come owing to the insecurity of the articles.

In order to solve such problems, some practitioners developed a simple fastening mechanism including a case, a driving unit and a spring. The case includes holes configured for the lace to pass therethrough. Through the reaction force between the spring and the driving unit, the lace can be clamped between the driving unit and the case so as to be fastened. The length of the lace can be changed by pressing the spring to change the position of the driving unit. However, in such fastening mechanism, the restoring force of the spring is served as the securing force; thus, the lace is easily to be released owing to vibrations or an external force. In addition, the fastening mechanism has no space to receive the lace, and the exposure of the lace may bring danger.

Therefore, some practitioners developed another kind of buckle which can be rotated to tighten the lace, and the lace can be received inside the buckle. Through the interference between components inside the buckle, the length of the lace as well as the tightness can be adjusted. However, the structure of the buckles is complex; as a result, the manufacturing cost is increased, and the buckle has assembly and repair difficulties.

Hence, the inner structure of the buckle is continuously improved by the practitioners, with a hope that the structure can be simplified while the securing capability thereof is remained, and the structure reliability thereof is increased to prevent shortenness of the life time.

Based on the aforementioned problems, how to simplify the structure of the fastening device, reduce the manufacturing cost and maintain the securing capability becomes a pursuit target for practitioners.

SUMMARY

According to one aspect of the present disclosure, a fastening device is provided. The fastening device includes a case unit, a spool, a driving unit, a knob and a connecting unit. The case unit includes an annular wall surrounding an inner space, an upper opening communicated with the inner space, a bottom opening opposite to the upper opening and communicated with the inner space, and a base detachably and directly coupled to the annular wall. The spool is located within the inner space. The driving unit is located within the inner space and selectively prohibits the spool from rotating in a loosening direction. The knob is disposed on the annular wall. The connecting unit is connected to at least one of the knob, the spool and the driving unit without passing through the base and restricted by at least one of the annular wall, the spool and the driving unit such that the annular wall, the spool, the driving unit and the knob are combined integrally.

DETAILED DESCRIPTION

The embodiment will be described with the drawings. For clarity, some practical details will be described below. However, it should be noted that the present disclosure should not be limited by the practical details. That is, in some embodiment, the practical details are unnecessary. In addition, for simplifying the drawings, some conventional structures and elements will be simply illustrated, and repeated elements may be represented by the same labels.

In addition, it will be understood that when an element (or mechanism or module) is referred to as being "disposed on", "connected to" or "coupled to" another element, it can be directly disposed on, connected or coupled to the other elements, or it can be indirectly disposed on, connected or coupled to the other elements, that is, intervening elements may be present. In contrast, when an element is referred to as being "directly disposed on", "directly connected to" or "directly coupled to" another element, there is no intervening element present. The terms first, second, third, etc. are used herein to describe various elements or components, these elements or components should not be limited by these terms. Consequently, a first element or component discussed below could be termed a second element or component.

Figure 1:
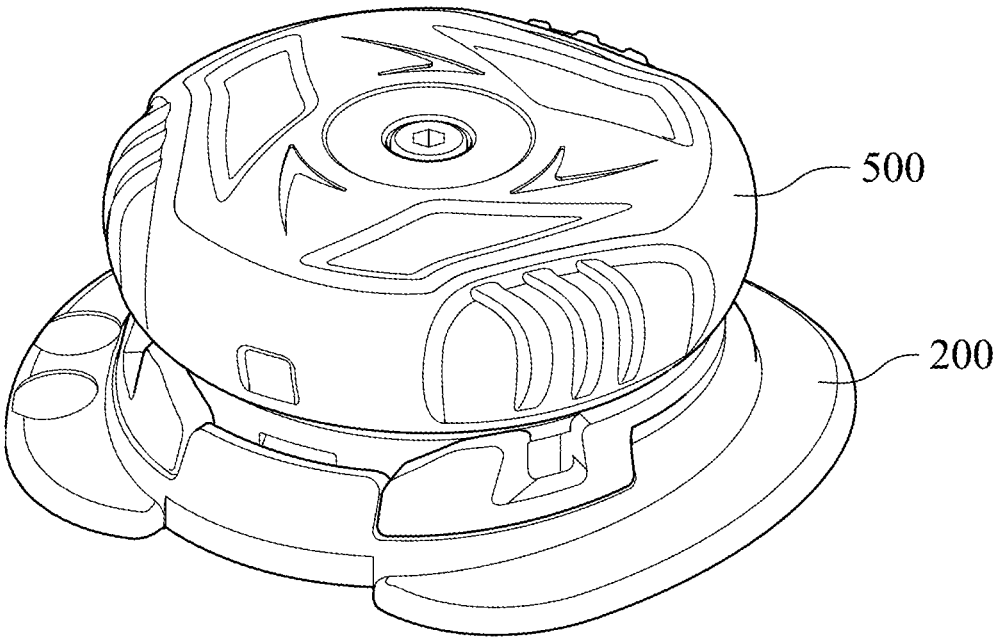
FIG. 1 shows a three-dimensional schematic view of a fastening device according to a first embodiment of the present disclosure.
Figure 2:
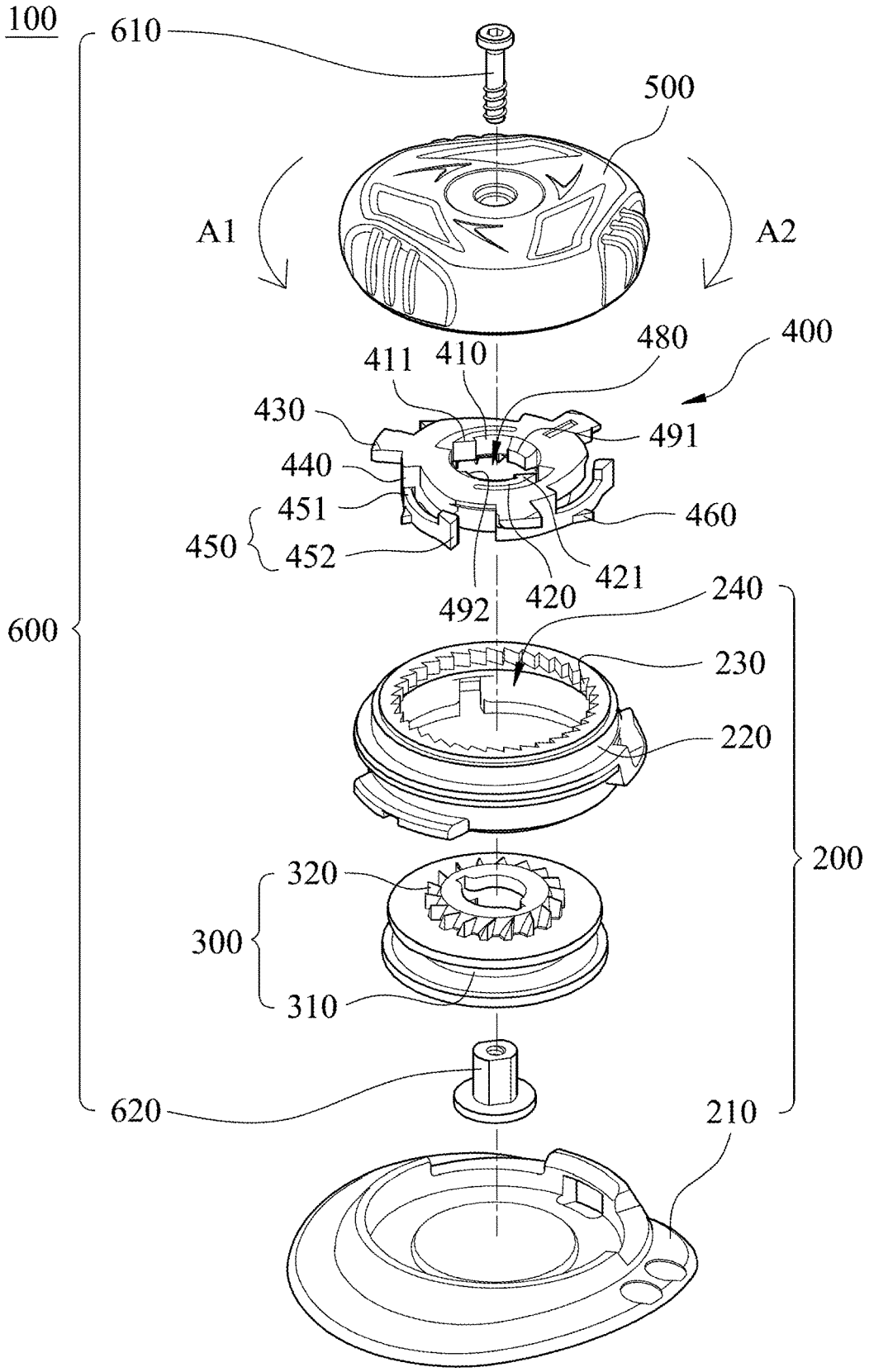
FIG. 2 shows one exploded view of the fastening device of FIG. 1.
Figure 3:
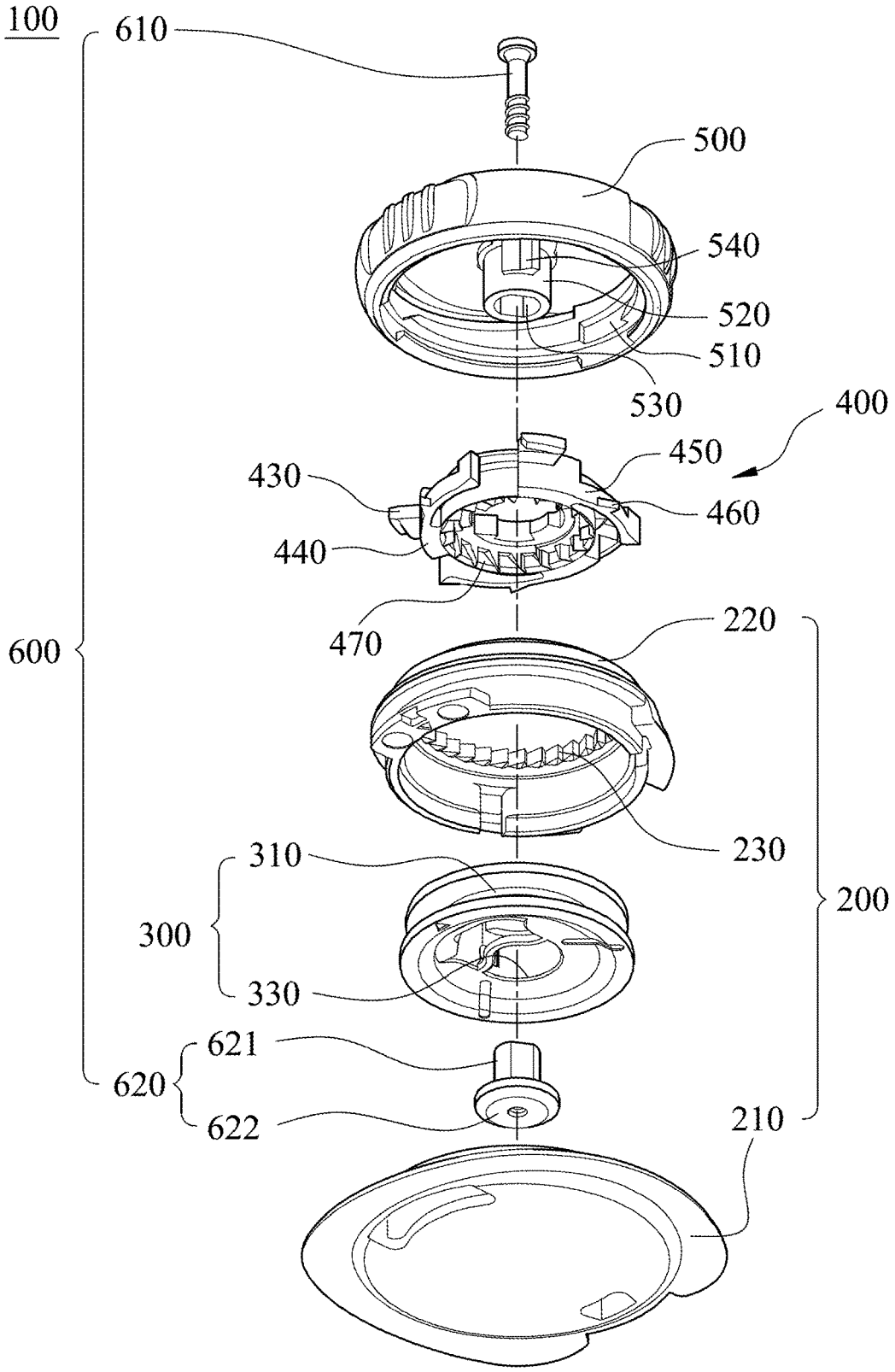
FIG. 3 shows another exploded view of the fastening device of FIG. 1.
Figure 4:
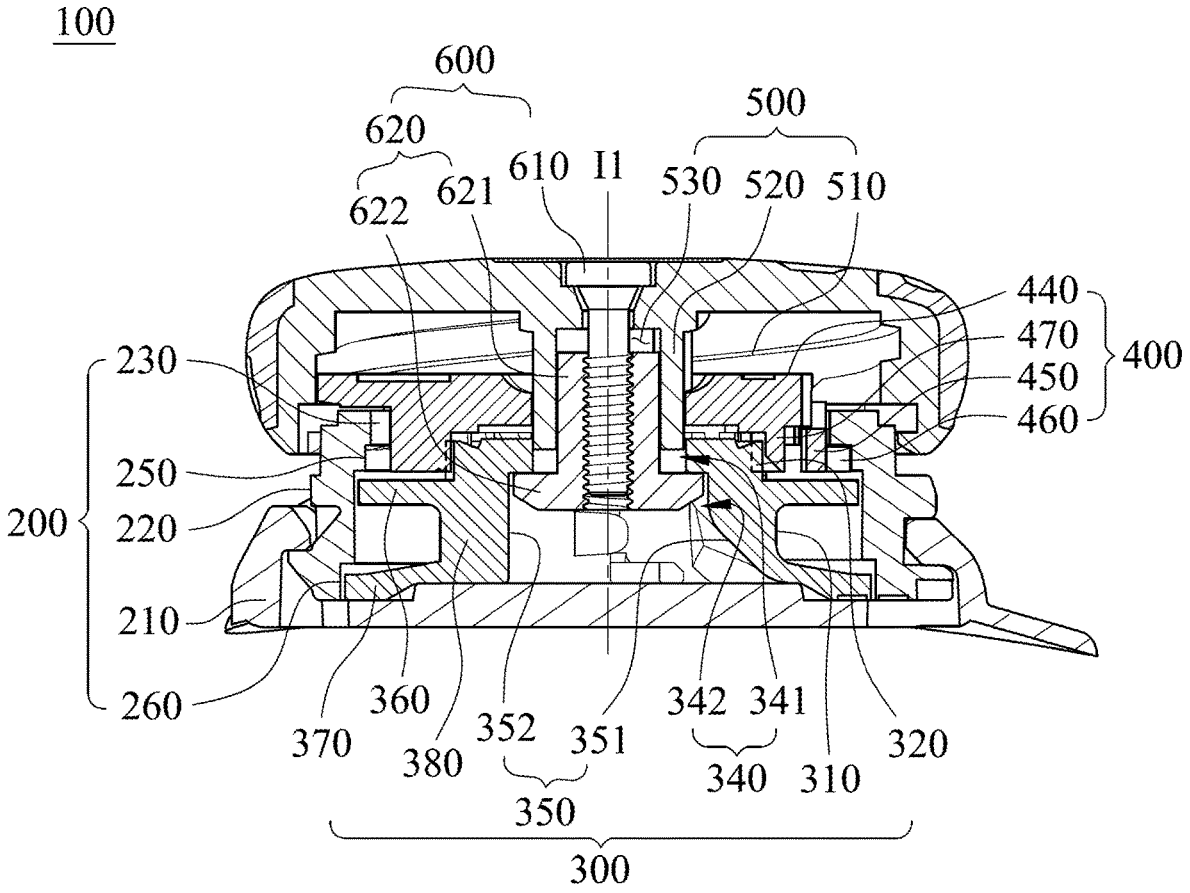
FIG. 4 shows one cross-sectional view of the fastening device of FIG. 1.
Figure 5:
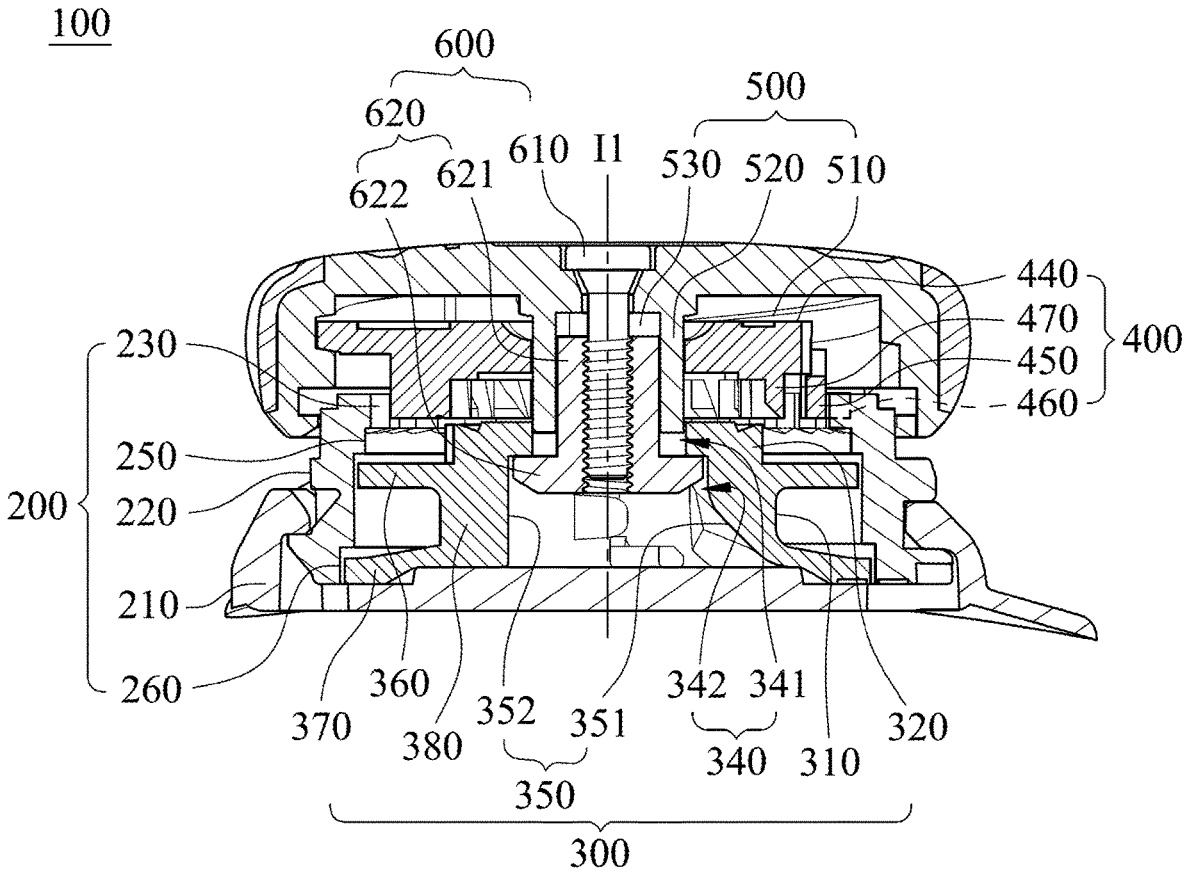
FIG. 5 shows another cross-sectional view of the fastening device of FIG. 1.

Please refer to FIGS. 1, 2, 3, 4, and 5. FIG. 1 shows a three-dimensional schematic view of a fastening device 100 according to a first embodiment of the present disclosure. FIG. 2 shows one exploded view of the fastening device 100 of FIG. 1. FIG. 3 shows another exploded view of the fastening device 100 of FIG. 1. FIG. 4 shows one cross-sectional view of the fastening device 100 of FIG. 1. FIG. 5 shows another cross-sectional view of the fastening device 100 of FIG. 1. The fastening device 100 includes a case unit 200, a spool 300, a driving unit 400, a knob 500 and a connecting unit 600.

The case unit 200 has a radial direction (not shown) and an axial direction I1 and includes an annular wall 220. The annular wall 220 surrounds an inner space 240. The spool 300 is within the inner space 240 and includes an axial space 340. The axial space 340 includes a large-diameter segment 342 and a small-diameter segment 341, and the small-diameter segment 341 is connected to the large-diameter segment 342 along the axial direction I1. The driving unit 400 is disposed above the spool 300 along the axial direction I1, and the driving unit 400 selectively prohibits the spool 300 from rotating in a loosening direction A1. The knob 500 is disposed above the driving unit 400 along the axial direction I1, and the knob 500 is coupled to the driving unit 400. The connecting unit 600 is connected to the knob 500, and the connecting unit 600 is disposed within the axial space 340 and limited within the large-diameter segment 342.

Therefore, since the axial space 340 of the spool 300 includes the large-diameter segment 342 and the small-diameter segment 341, the connecting unit 600 can be limited within the large-diameter segment 342, and separation of the case unit 200, the spool 300, the driving unit 400 and the knob 500 during rotation can be avoided, thereby increasing the structure reliability. The detail of the fastening device 100 will be described hereafter.

The case unit 200 can further include a stop portion 250, and the stop portion 250 is located at the annular wall 220 and protrudes toward the inner space 240 along the radial direction. The spool 300 is located below the stop portion 250. The case unit 200 can further include a base 210, a plurality of mounting teeth 230 and an inner annular groove 260. The base 210 is configured for the annular wall 220 to be disposed thereon, and the annular wall 220 can be assembled with the base 210 through engagements. The mounting teeth 230 are disposed at the annular wall 220 and face toward the inner space 240, and the inner annular groove 260 is located at a lower end of the annular wall 220. The mounting teeth 230 are located on an upper end of the annular wall 220. The stop portion 250 has a convex ring structure and is adjacent to the mounting teeth 230. In other words, the inner annular groove 260 and the stop portion 250 can be formed by the variation of the inner-diameter of the annular wall 220.

The spool 300 includes a hollow shaft 380, an upper annular portion 360 and a lower annular portion 370. The upper annular portion 360 and the lower annular portion 370 protrude outwardly from the hollow shaft 380 along the radial direction, respectively, and the upper annular portion 360 is located above the lower annular portion 370 along the axial direction I1, thereby allowing an annular track 310 to be formed between the upper annular portion 360 and the lower annular portion 370. The annular track 310 can be configured for a lace (not shown) to be wound thereabout. The spool 300 can include a plurality of engaging teeth 320 located above the upper annular portion 360 along the axial direction I1, and an inner surface 350 of the hollow shaft 380 is closed to form the axial space 340. The large-diameter segment 342 and the lower-diameter segment 341 connected thereto can be formed by the variation of the inner-diameter of the hollow shaft 380, and the large-diameter segment 342 is located below the small-diameter segment 341. The inner surface 350 of the hollow shaft 380 can include an expanding region 351 and a perpendicular region 352, and both of the expanding region 351 and a perpendicular region 352 are located at the large-diameter segment 342. The spool 300 can further include a lower opening 330 connected to the axial space 340.

The driving unit 400 can include a ring body portion 440, a first retaining portion 410, a second retaining portion 420, three guiding portions 430, three pawl arms 450, three restricting portions 460, a plurality of meshing teeth 470, a central hole 480 and two protrusions 491 and 492. The central hole 480 is located at a center of the ring body portion 440, and each of the guiding portions 430 has a helical tooth structure protruding outwardly from the ring body portion 440 and is configured to couple to the knob 500. The first retaining portion 410 and the second retaining portion 420 include a free end 411 and a free end 421, respectively. The free ends 411 and 421 can be displaced radially by a force, and can be restored after removing the force. The protrusions 491 and 492 protrude inwardly from the ring body portion 440, and the two protrusions 491 and 492 are spaced apart from the two free ends 411 and 421. Each of the pawl arms 450 includes a distal end 452 and a proximal end 451. The proximal ends 451 are configured to connect to an outside of the ring body portion 440, and the distal ends 452 are configured to selectively engage with the mounting teeth 230. The three restricting portions 460 are located above the three pawl arms 450, respectively. The meshing teeth 470 are located at a lower side of the ring body portion 440, which can be selectively engaged with the engaging teeth 320 of the spool 300.

The knob 500 can include a guiding track 510, a boss 520, a through hole 530 and two positioning blocks 540. The guiding track 510 is located at an inner wall of the knob 500, and the boss 520 protrudes into the inner space 240 along the axial direction I1. The through hole 530 passes through the boss 520. The two positioning blocks 540 are disposed at an outside of the boss 520 along the radial direction. Please be noted that, only one position block 540 is shown in FIG. 3 owing to the view angle thereof, and it can be understood by a reader that, on the other side which cannot be seen, the other positioning block 540 is located.

The connecting unit 600 includes a first part set (not labeled) and a second part set (not labeled). The first part set is connected to the knob 500. The second part set is disposed within the axial space 340 to connect to the first part set, and the second part set is limited within the large-diameter segment 342. In the first embodiment, the first part set of the connecting unit 600 can include a screw bar 610. The second part set can include a connecting barrel 620, and the connecting barrel 620 includes a top portion 622 and a barrel body portion 621. The barrel body portion 621 is connected to the top portion 622. The barrel body portion 621 passes through the small-diameter segment 341 and is configured for the screw bar 610 to screw therewith, and the top portion 622 is limited within the large-diameter segment 342.

Precisely, when the spool 300 is put into the inner space 240 from the bottom of the annular wall 220, as shown in FIG. 4, the upper annular portion 360 and the lower annular portion 370 can be limited by the stop portion 250 and the inner annular groove 260, respectively, thereby avoiding the spool 300 from leaving from the upper side of the annular wall 220. The guiding portions 430 (shown in FIG. 3) are coupled to the guiding track 510 to connect the driving unit 400 to the knob 500. The boss 520 of the knob 500 protrudes into the central hole 480 (shown in FIG. 2) of the driving unit 400.

The connecting barrel 620 can be put from the lower opening 330 (shown in FIG. 3) into the axial space 340, and through the diameter relationship of the small-diameter segment 341, the large-diameter segment 342, the top portion 622 and the barrel body portion 621, the barrel body portion 621 can pass through the small-diameter segment 341 while the top portion 622 is limited within the large-diameter segment 342. Then, the screw bar 610 is fastened into the barrel body portion 621, and combination of the knob 500, the driving unit 400 and the spool 300 is completed. Because of the stop portion 250, after the screw bar 610 is fastened with the barrel body portion 621, the knob 500, the driving unit 400, the spool 300 and the annular wall 220 cannot separate from each other, thereby completing assembly. In other embodiments, the stop portion can be omitted; instead, the mounting teeth can protrude into the inner space to prevent the spool from leaving from the upper side of the annular wall. Moreover, only one of the stop portion and the inner annular groove is required to be disposed on the annular wall, and the present disclosure is not limited thereto.

Furthermore, the barrel body portion 621 can be engaged with the boss 520, thereby allowing the connecting barrel 620 and the knob 500 to move simultaneously. A shape of the outer wall of the barrel body portion 621 can coordinate with the inner wall of the through hole 530, which results in engagement between the barre body portion 621 and the boss 520. Moreover, the outer wall of the barrel body portion 621 and the inner wall of the through hole 530 are non-circular. When pulling the lace to rotate the spool 300 in a loosening direction A1, the spool 300 may rub against the second part set, and if the barrel body portion 621 of the second part set is engaged with the boss 520, rotation of the second part set caused by the friction from the spool 300 can be avoided, thereby avoiding it from separating from the first part set.

As shown in FIG. 4, the driving unit 400 is in the first position, and the engaging teeth 320 of the spool 300 are engaged with the meshing teeth 470 of the driving unit 400. The distal ends 452 (shown in FIG. 2) of each of the pawl arms 450 are engaged with the mounting teeth 230 in the loosening direction A1 (shown in FIG. 2) while disengaged from the mounting teeth 230 in a fastening direction A2 (shown in FIG. 2). The restricting portion 460 is not engaged with the mounting teeth 230 owing to that the location of the restricting portion 460 is lower than the mounting teeth 230.

Hence, rotating the knob 500 in the fastening direction A2 can drive the driving unit 400 to allow the spool 300 to draw back the lace. When the knob 500 is immobile, the distal end 452 of each of the pawl arms 450 is abutted against the mounting teeth 230 to prevent rotation of the spool 300 in the loosening direction A1, thereby avoiding release of the lace.

On the contrary, rotating the knob 500 in a loosening direction A1 drives the driving unit 400 to move upward along the axial direction I1, such that the driving unit 400 is separated from the spool 300. To be more specific, when the driving unit 400 is in the first position, the guiding portions 430 are engaged with the guiding track 510 of the knob 500. One of the position blocks 540 is located between the free end 411 of the first retaining portion 410 and the protrusion 491, and the other one of the position blocks 540 is located between the free end 421 of the second retaining portion 420 and the protrusion 492. When the knob 500 is rotated in the loosening direction A1, the driving unit 400 cannot rotate simultaneously owing to the engagement between the pawl arms 450 and the mounting teeth 230, and therefore the two positioning blocks 540 press the two free ends 411 and 421, respectively, which allows the two free ends 411 and 421 to be displaced along the radial direction such that the knob 500 can rotate relative to the driving unit 400. The guiding portions 430 will be guided by the guiding track 510 to move upward relative to the guiding track 510 along the axial direction I1, allowing the driving unit 400 to switch to the second position. Hence, the aforementioned one of the positioning blocks 540 switches to a position between the free end 411 of the first retaining portion 410 and the protrusion 492, and the aforementioned the other one of the positioning blocks 540 switches to a position between the free end 421 of the second retaining portion 420 and the protrusion 491.

Hence, as shown in FIG. 5, when the driving unit 400 is in the second position, the meshing teeth 470 of the driving unit 400 will disengage from the engaging teeth 320 of the spool 300, and the spool 300 is not affected by the driving unit 400 and rotation in the loosening direction A1 is allowed; as a result, the lace can be released by pulling the lace itself.

Figure 6:
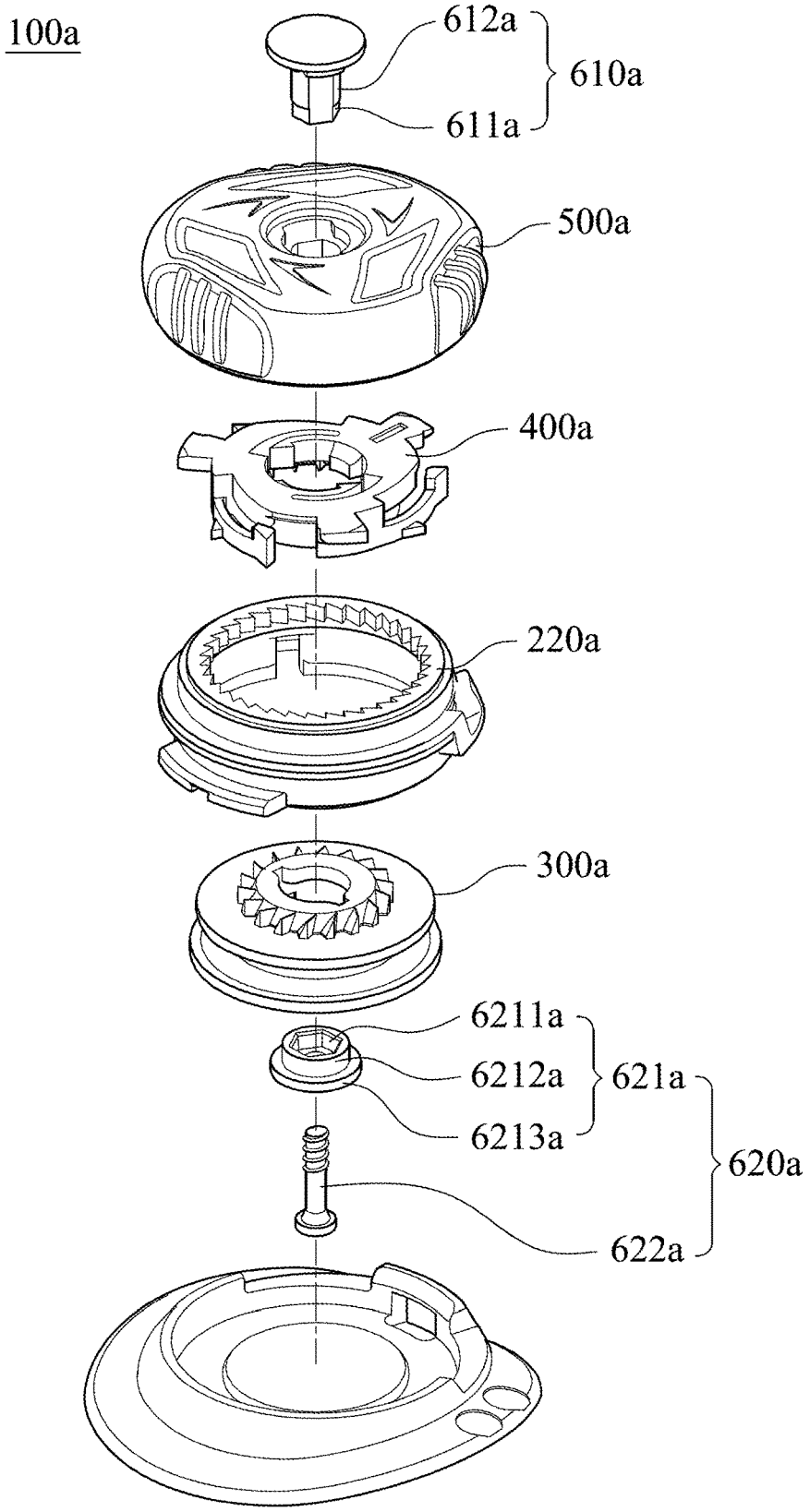
FIG. 6 shows a three-dimensional exploded view of a fastening device according to a second embodiment of the present disclosure.
Figure 7:
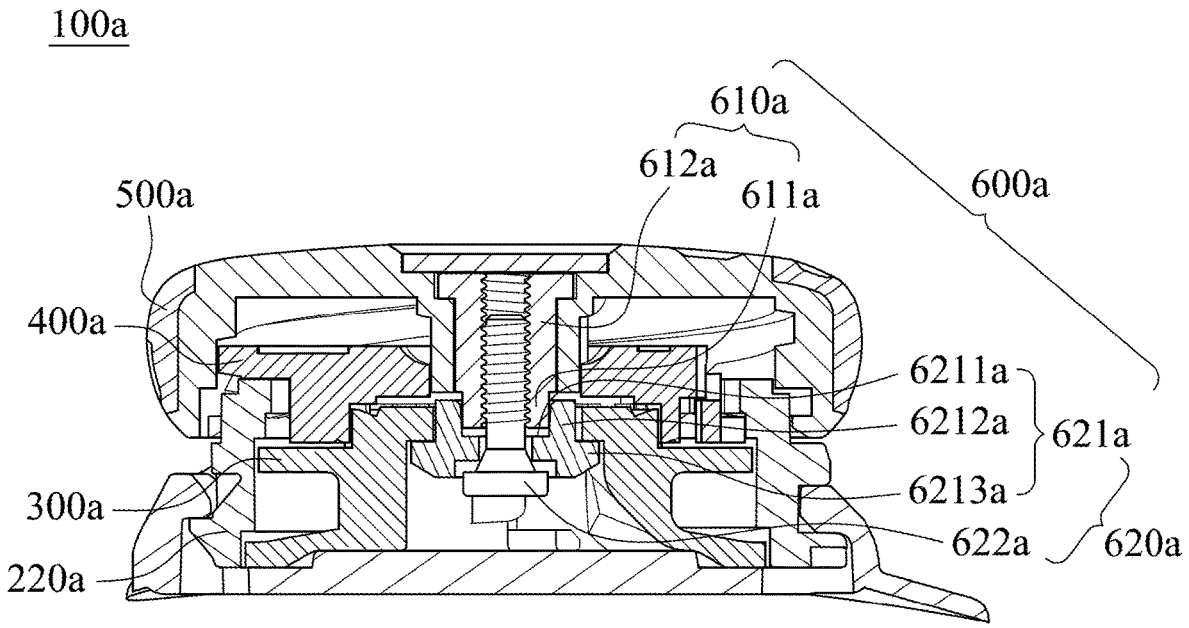
FIG. 7 shows a cross-sectional view of the fastening device of FIG. 6.

Please refer to FIG. 6 and FIG. 7. FIG. 6 shows a three-dimensional exploded view of a fastening device 100*a* according to a second embodiment of the present disclosure. FIG. 7 shows a cross-sectional view of the fastening device 100*a* of FIG. 6. The fastening device 100*a* includes a case unit (not labeled), a spool 300*a*, a driving unit 400*a*, a knob 500*a* and a connecting unit 600*a*. The structure and relation of the case unit, the spool 300*a*, the driving unit 400*a* and the knob 500*a* are similar to that of the case unit 200, the spool 300, the driving unit 400 and the knob 500 in the first embodiment, but the structure of the connecting unit 600*a* is different from the connecting unit 600 of the first embodiment.

The connecting unit 600*a* includes a first part set and a second part set 620*a*. The first part set includes a fastening barrel 610*a*. The second part set 620*a* includes a stop ring 621*a* and a screw bar 622*a*. The stop ring 621*a* is limited within the large-diameter segment (not labeled), and the screw bar 622*a* passes through the stop ring 621*a* and the small-diameter segment (not labeled) to screw with the fastening barrel 610*a*. The fastening barrel 610*a* can include a lower engaging portion 611*a*. The stop ring 621*a* includes an inner engaging groove 6211*a*, and the inner engaging groove 6211*a* is configured to engage with the lower engaging portion 611*a*. The knob 500*a* can include a boss (not labeled) protruding toward the inner space (not labeled) along the axial direction. The fastening barrel 610*a* can further include an upper engaging portion 612*a* connected to the lower engaging portion 611*a*, and the upper engaging portion 612*a* is engaged with the boss.

To be more specific, the stop ring 621*a* further includes a bottom portion 6213*a* and a body portion 6212*a*. The body portion 6212*a* is connected to the bottom portion 6213*a*, and the inner engaging groove 6211*a* is located at the body portion 6212*a*. The shape of the upper engaging portion 612*a* of the fastening barrel 610*a* fits the through hole (not labeled) of the boss, and the shape of the lower engaging portion 611*a* fits the inner engaging groove 6211*a*. Hence, when the fastening barrel 610*a* passes through the through hole, the upper engaging portion 612*a* is engaged with the boss, and the lower engaging portion 611*a* exposes from the boss to protrude toward the small-diameter segment.

In addition, as shown in FIG. 7, the body portion 6212*a* of the stop ring 621*a* passes through the small-diameter segment, and the inner engaging groove 6211*a* is engaged with the lower engaging portion 611*a*. The bottom portion 6213*a* is remained in the large-diameter segment to be limited within the large-diameter segment, and the screw bar 622*a* can fasten into the fastening barrel 610*a* upward from a bottom side thereof along the axial direction, thereby completing combination of the knob 500*a*, the driving unit 400*a*, the spool 300*a* and the annular wall 220*a*. As pulling the lace to rotate the spool 300*a* in the loosening direction, the spool 300*a* may rub against the second part set 620*a*, and because the stop ring 621*a* of the second part set 620*a* is engaged with the boss through the fastening barrel 610*a*, rotation of the second part set 620*a* caused by the friction can be avoided, which also avoids separation between the first part set and the second part set 620*a*.

Figure 8:
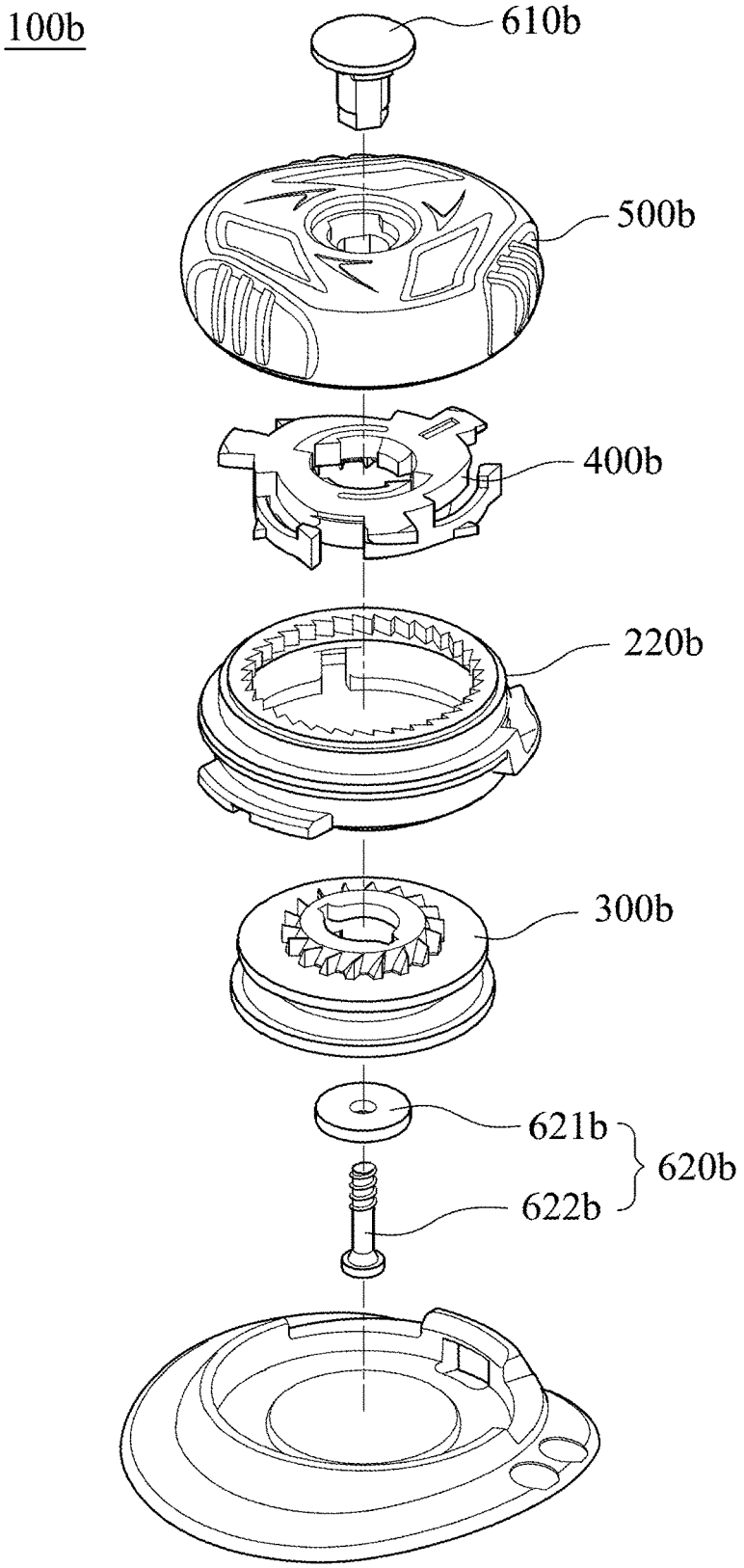
FIG. 8 shows a three-dimensional exploded view of a fastening device according to a third embodiment of the present disclosure.
Figure 9:
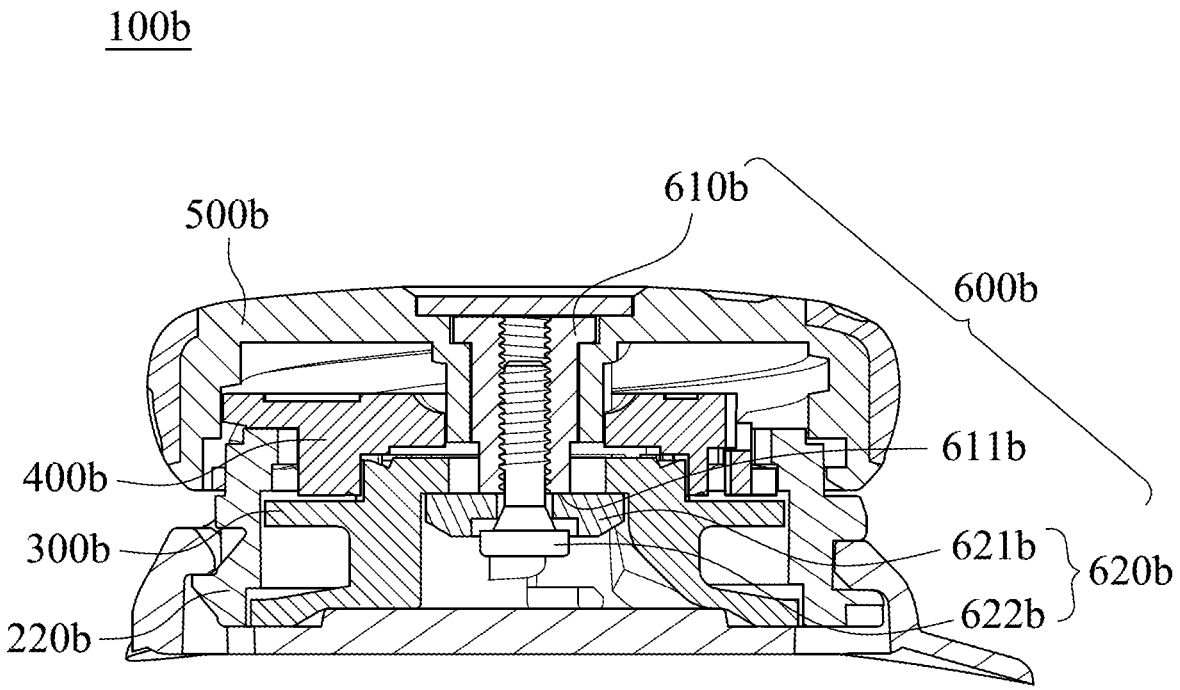
FIG. 9 shows a cross-sectional view of the fastening device of FIG. 8.

Please refer to FIG. 8 and FIG. 9. FIG. 8 shows a three-dimensional exploded view of a fastening device 100*b* according to a third embodiment of the present disclosure. FIG. 9 shows a cross-sectional view of the fastening device 100*b* of FIG. 8. The fastening device 100*b* includes a case unit (not shown), a spool 300*b*, a driving unit 400*b*, a knob 500*b* and a connecting unit 600*b*. The structure and relation of the case unit, the spool 300*b*, the driving unit 400*b* and the knob 500*b* are similar to that of the case unit, the spool 300*a*, the driving unit 400*a* and the knob 500*a* in the second embodiment, but the structure of the connecting unit 600*b* is different from the connecting unit 600*a* of the second embodiment.

Precisely, the first part set of the connecting unit 600*b* includes a fastening barrel 610*b*, and the second part set 620*b* includes a stop ring 621*b* and a screw bar 622*b*. The structure of the fastening barrel 610*b* is identical to the fastening barrel 610*a* of the second embodiment, but the lower engaging portion is omitted while the length of the upper engaging portion along the axial direction is elongated to protrude into the small-diameter segment. The present disclosure includes the above but is not limited thereto. In the third embodiment, the stop ring 621*b* has a ring structure, and the fastening barrel 610*b* includes a lower end surface 611*b*. After the screw bar 622*b* is fastened into the fastening barrel 610*b*, the stop ring 621*b* is abutted against the lower end surface 611*b*, such that combination of the knob 500*b*, the driving unit 400*b*, the spool 300*b* and the annular wall 220*b* are completed. As pulling the lace to rotate the spool 300*b* in the loosening direction, the spool 300*b* may rub against the second part set 620*b*, and because the stop ring 621*b* is forced by the screw bar 622*b* to abut against the lower end surface 611*b*, the friction between the stop ring

621*b*, the screw bar 622*b* and the lower end surface 611*b* is larger than that between the spool 300*b* and the stop ring 621*b*; therefore, rotation of the second part set 620*b* caused by the friction can be avoided, which also avoids separation between the first part set and the second part set 620*b*.

Figure 10:
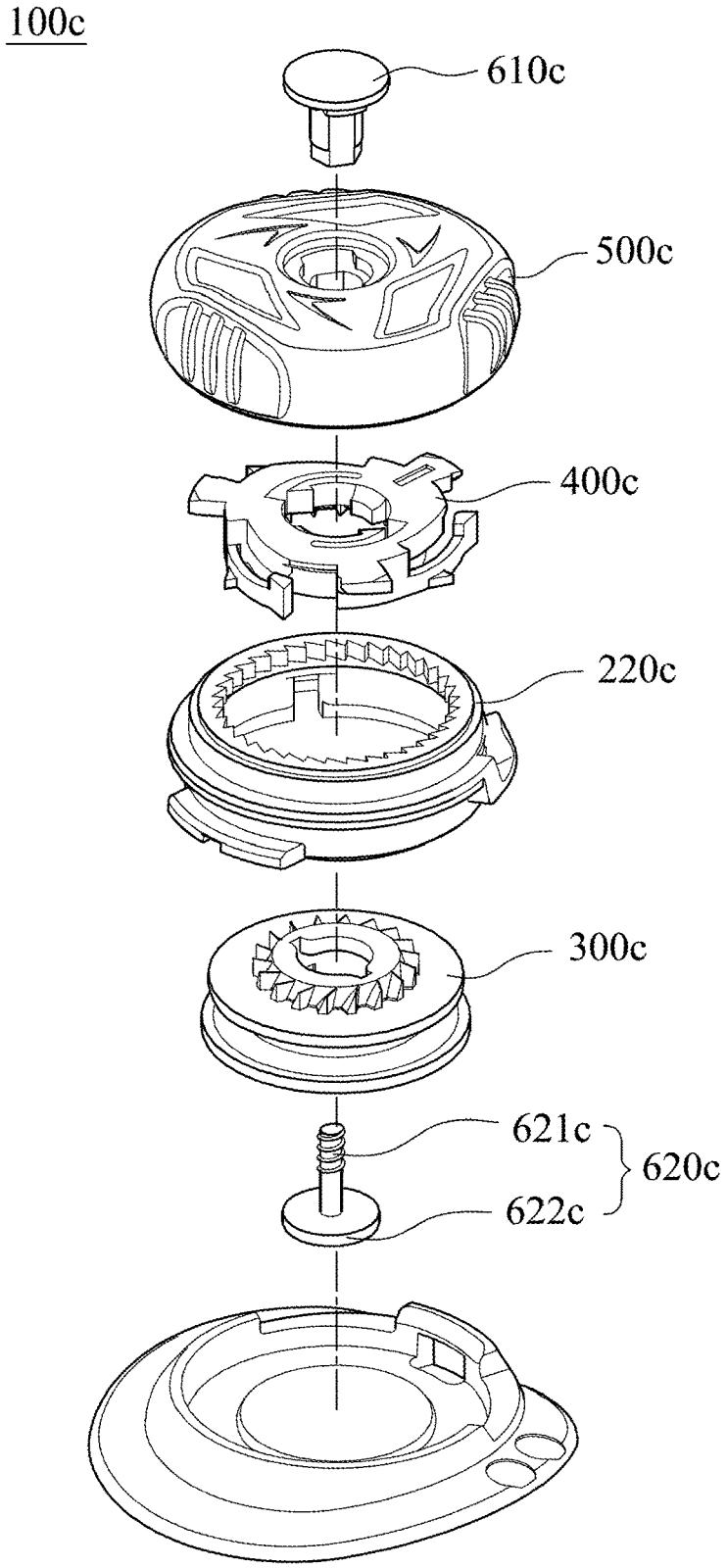
FIG. 10 shows a three-dimensional exploded view of a fastening device according to a fourth embodiment of the present disclosure.
Figure 11:
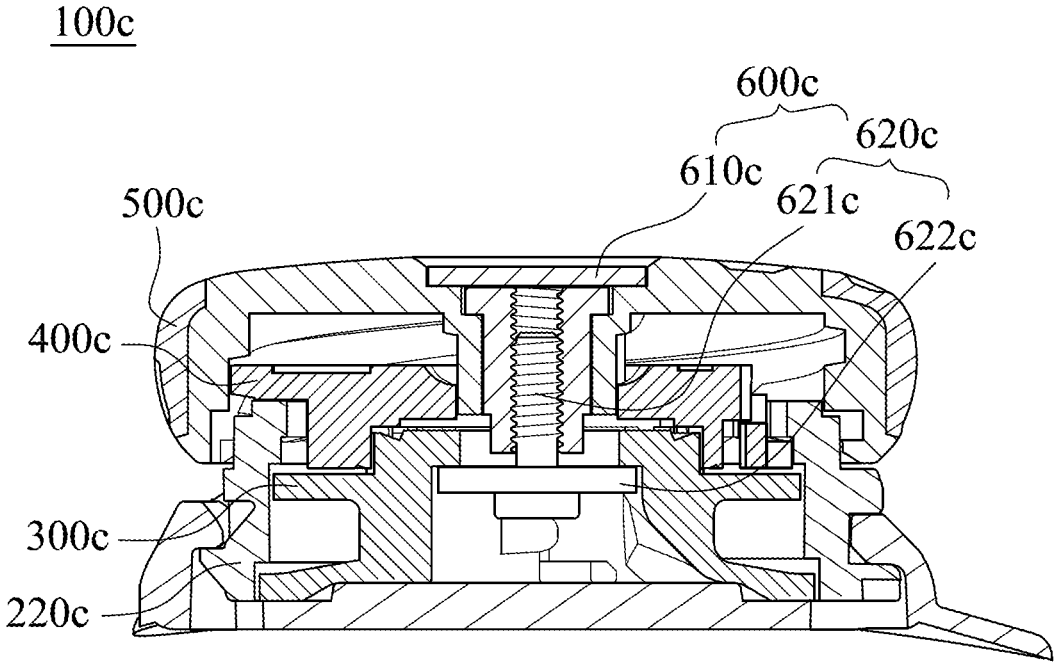
FIG. 11 shows a cross-sectional view of the fastening device of FIG. 10.

Please refer to FIG. 10 and FIG. 11. FIG. 10 shows a three-dimensional exploded view of a fastening device 100*c* according to a fourth embodiment of the present disclosure. FIG. 11 shows a cross-sectional view of the fastening device 100*c* of FIG. 10.

The fastening device 100*c* includes a case unit (not shown), a spool 300*c*, a driving unit 400*c*, a knob 500*c* and a connecting unit 600*c*. The structure and relation of the case unit, the spool 300*c*, the driving unit 400*c* and the knob 500*c* are similar to that of the case unit, the spool 300*b*, the driving unit 400*b* and the knob 500*b* in the third embodiment, but the structure of the connecting unit 600*c* is different from the connecting unit 600*b* of the third embodiment.

Precisely, the first part set of the connecting unit 600*c* includes a fastening barrel 610*c*, and the second part set includes a screw bar 620*c*. The screw bar 620*c* includes a head portion 622*c* and a bar portion 621*c*, and the bar portion 621*c* is connected to the head portion 622*c*. The bar portion 621*c* inserts in the axial space to fasten the fastening barrel 610*c*, and the head portion 622*c* is limited within the large-diameter segment. In configuration, the diameter of the head portion 622*c* can be larger than the diameter of the small-diameter segment, and the diameter of the screw bar 620*c* is smaller than the large-diameter segment, such that the screw bar 620*c* can be limited within the large-diameter segment, thereby completing combination of the knob 500*c*, the driving unit 400*c*, the spool 300*c* and the annular wall 220*c*. As pulling the lace to rotate the spool 300*c* in the loosening direction, the spool 300*c* may rub against the second part set, and therefore the fastening force between the screw bar 620*c* and the fastening barrel 610*c* can be enlarged when fastening the screw bar 620*c*. For example, the teeth pitch thereof can be widened, or a glue can be dispended thereon, which avoids rotation of the second part set caused by friction and separation between the first part set and the second part set.

In other embodiments, the connecting unit can have a boss structure, which can be integrally connected to the knob and can protrude into the axial space, or it can be secured on the knob by adhesion of glue. The connecting unit can include a lower flange, and with the upper end connected to the knob and the lower flanged limited within the large-diameter segment, the combination of the knob, the driving unit, the spool and the annular wall can be completed.

Figure 12:
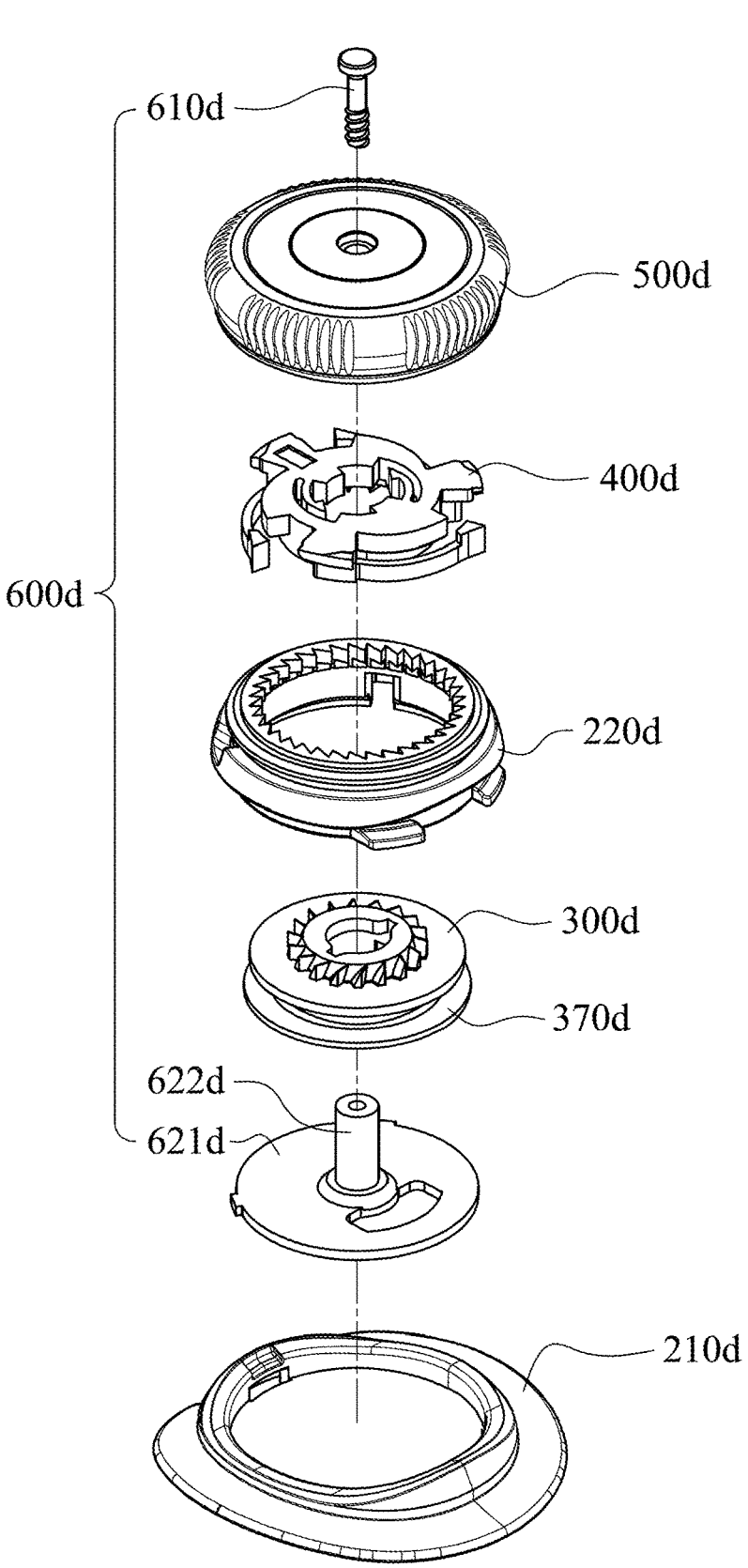
FIG. 12 shows one exploded view of a fastening device according to a fifth embodiment of the present disclosure.
Figure 13:
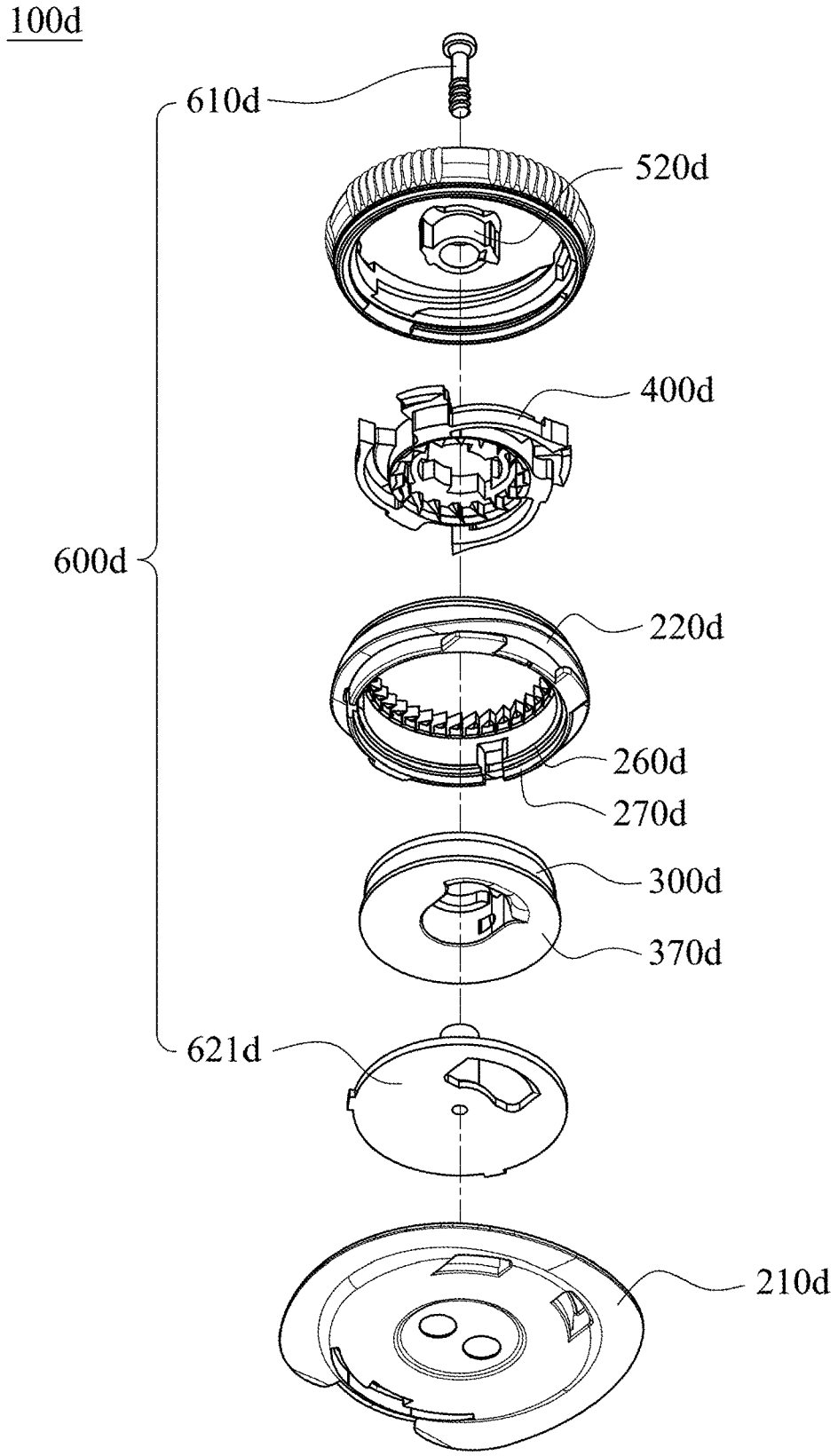
FIG. 13 shows another exploded view of the fastening device of FIG. 12.
Figure 14:
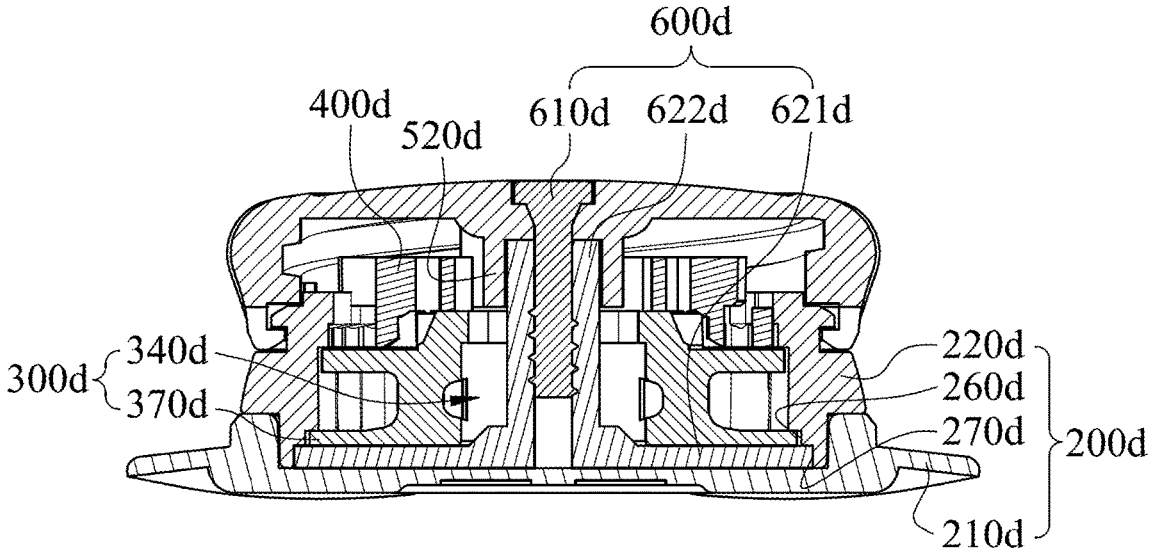
FIG. 14 shows a cross-sectional view of the fastening device of FIG. 12.

Please refer to FIG. 12, FIG. 13 and FIG. 14. FIG. 12 shows one exploded view of a fastening device 100*d* according to a fifth embodiment of the present disclosure, FIG. 13 shows another exploded view of the fastening device 100*d* of FIG. 12, and FIG. 14 shows a cross-sectional view of the fastening device 100*d* of FIG. 12. The fastening device 100*d* includes a case unit 200*d*, a spool 300*d*, a driving unit 400*d*, a knob 500*d* and a connecting unit 600*d*. The case unit 200*d* includes an annular wall 220*d* surrounding an inner space, an upper opening communicated with the inner space, a bottom opening opposite to the upper opening and communicated with the inner space, and a base 210*d* detachably and directly coupled to the annular wall 220*d*. The spool 300*d* is located within the inner space. The driving unit 400*d* is located within the inner space and selectively prohibits the spool 300*d* from rotating in a loosening direction. The knob 500*d* is disposed on the annular wall 220*d*. The connecting unit 600*d* is connected to at least one of the knob 500*d*, the spool 300*d* and the driving unit 400*d* without passing through the base 210*d* and is restricted by at least one of the annular wall 220*d*, the spool 300*d* and the driving unit 400*d* such that the annular wall 220*d*, the spool 300*d*, the driving unit 400*d* and the knob 500*d* are combined integrally.

Precisely, the case unit 200*d* can further include a first inner annular groove 270*d* located at a lower end of the annular wall 220*d*, and the connecting unit 600*d* can include a plate 621*d* received in the first inner annular groove 270*d* so as to be restricted by the annular wall 220*d*. The connecting unit 600*d* can further include a screw bar 610*d* and a shaft 622*d*, and the shaft 622*d* protrudes upwardly from the center of the plate 621*d*. The plate 621*d* is located below the spool 300*d*, and the shaft 622*d* is inserted into the axial space 340*d* of the spool 300*d* to connect to the boss 520*d* of the knob 500*d*. Than the screw bar 610*d* can screw into a channel of the shaft 622*d*. Because the plate 621*d* is received in the first inner annular groove 270*d* and is restricted by the annular wall 220*d*, as the screw bar 610*d* is fastened with the shaft 622*d* from the knob 500*d*, the knob 500*d*, the spool 300*d* and the driving unit 400*d* are combined with the annular wall 220*d*. The base 210*d* can be assembled with the annular wall 220*d* via engagement.

The case unit 200*d* can further include a second inner annular groove 260*d* located at the annular wall 220*d* and located above the first inner annular groove 270*d*. A lower annular portion 370*d* of the spool 300*d* is received in the second inner annular groove 260*d*. Through the configuration, the combination strength between the knob 500*d*, the annular wall 220*d*, the spool 300*d* and the driving unit 400*d* is increased. However, in other embodiments, the case unit can include only one of the first inner annular groove and the second inner annular groove, and the present disclosure will not be limited thereto. For example, the case unit can include only the second inner annular groove, and the spool is restricted by the annular wall. Consequently, because the plate is located below the spool, the annular wall, the spool, the driving unit and the knob are still combined integrally.

Figure 15:
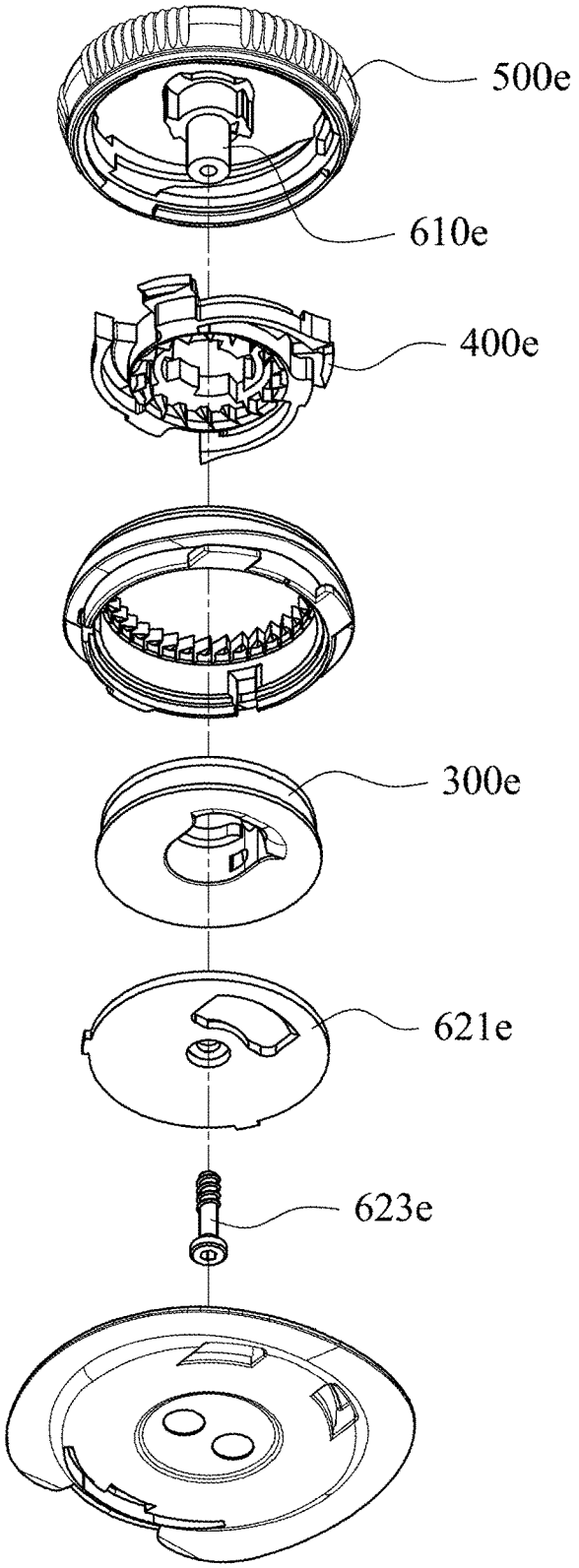
FIG. 15 shows an exploded view of a fastening device according to a sixth embodiment of the present disclosure.
Figure 16:
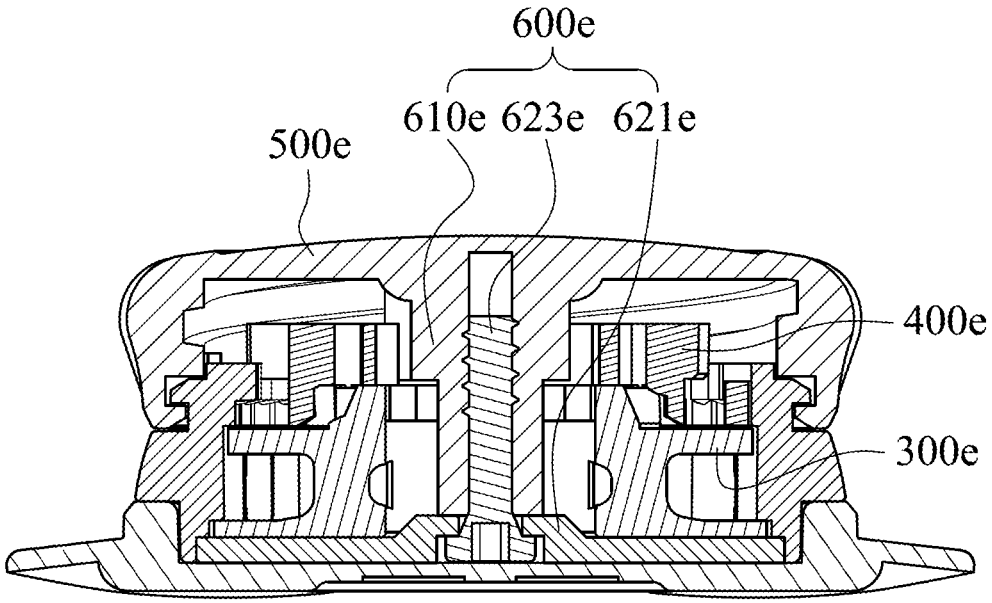
FIG. 16 shows a cross-sectional view of the fastening device of FIG. 15.

Please refer to FIG. 15 and FIG. 16. FIG. 15 shows an exploded view of a fastening device 100*e* according to a sixth embodiment of the present disclosure, and FIG. 16 shows a cross-sectional view of the fastening device 100*e* of FIG. 15. The fastening device 100*e* includes a case unit (its reference numeral is omitted), a spool 300*e*, a driving unit 400*e*, a knob 500*e* and a connecting unit 600*e*. The connecting unit 600*e* can include a post 610*e*, a plate 621*e* and a screw bar 623*e*. The post 610*e* is directly connected to an inner wall the knob 500*e* and protrudes into the axial space. The screw bar 623*e* screws the plate 621*e* to the post 610*e*.

To be more specific, the post 610*e* protrudes integrally from the inner wall of the 500*e*, and the post 610*e* is longer enough to protrude into the axial space of the spool 300*e* to touch the plate 621*e*. When the screw bar 623*e* is inserted into a hole of the plate 621*e* to screw into the post 610*e*, a head of the screw bar 623*e* is restricted by the plate 621*e*, and the plate 621*e* is abutted against an end surface of the post 610*e*.

Figure 17:
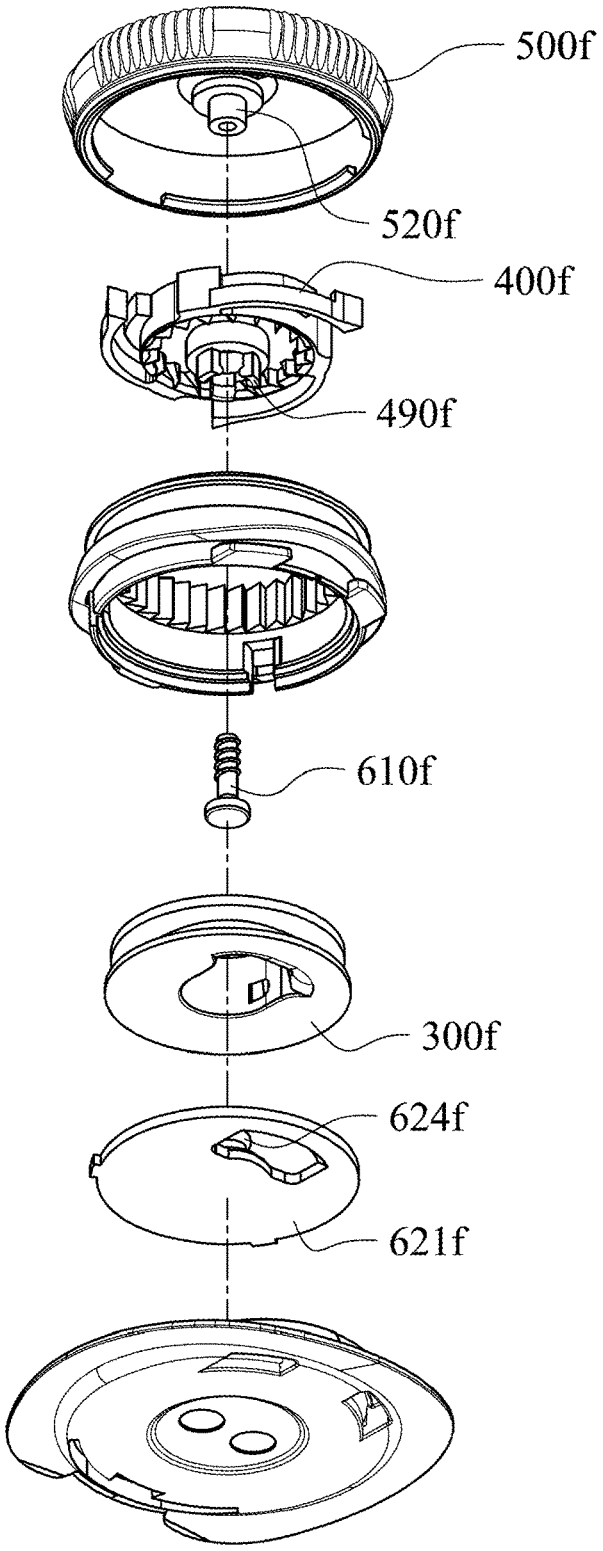
FIG. 17 shows an exploded view of a fastening device according to a seventh embodiment of the present disclosure.
Figure 18:
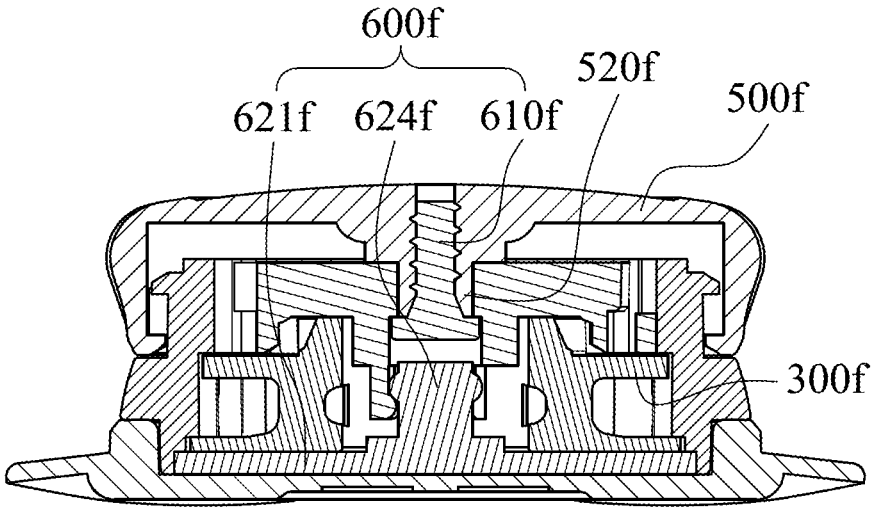
FIG. 18 shows a cross-sectional view of the fastening device of FIG. 17.

Please refer to FIG. 17 and FIG. 18. FIG. 17 shows an exploded view of a fastening device 100*f* according to a seventh embodiment of the present disclosure, and FIG. 18 shows a cross-sectional view of the fastening device 100*f* of FIG. 17. The fastening device 100*f* includes a case unit (its reference numeral is omitted), a spool 300*f*, a driving unit 400*f*, a knob 500*f* and a connecting unit 600*f*. The connecting unit 600*f* includes a screw bar 610*f*, a plate 621*f* and a plug 624*f*. The screw bar 610*f* is connected to the knob 500*f* and is restricted by the driving unit 400*f*. Precisely, the screw bar 610*f* is screwed from a central hole of the driving unit 400*f* into a boss 520*f* of the knob 500*f*. A head of the screw bar 610*f* is restricted by the driving unit 400*f*. The plug 624*f* protrudes upwardly from the plate 621*f* and is inserted into the axial space of the spool 300*f* to couple to the driving unit 400*f*. To be more specific, the plug 624*f* is inserted into the central hole of the driving unit 400*f*, and three clamping arms 490*f* of the driving unit 400*f* are coupled to the plug 624*f*. When the knob 500*f* is pulled upwardly, the driving unit 400*f* is lifted and is positioned by the plug 624*f*.

Figure 19:
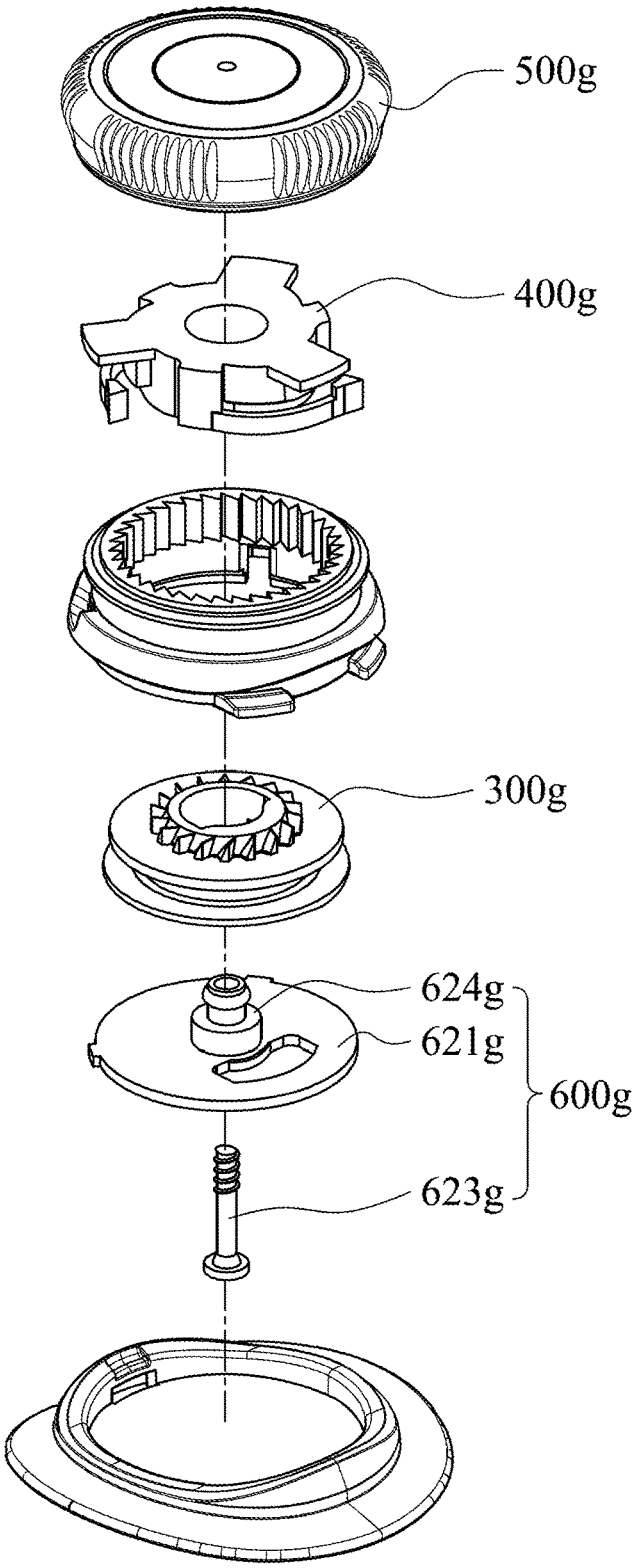
FIG. 19 shows one exploded view of a fastening device according to an eighth embodiment of the present disclosure.
Figure 20:
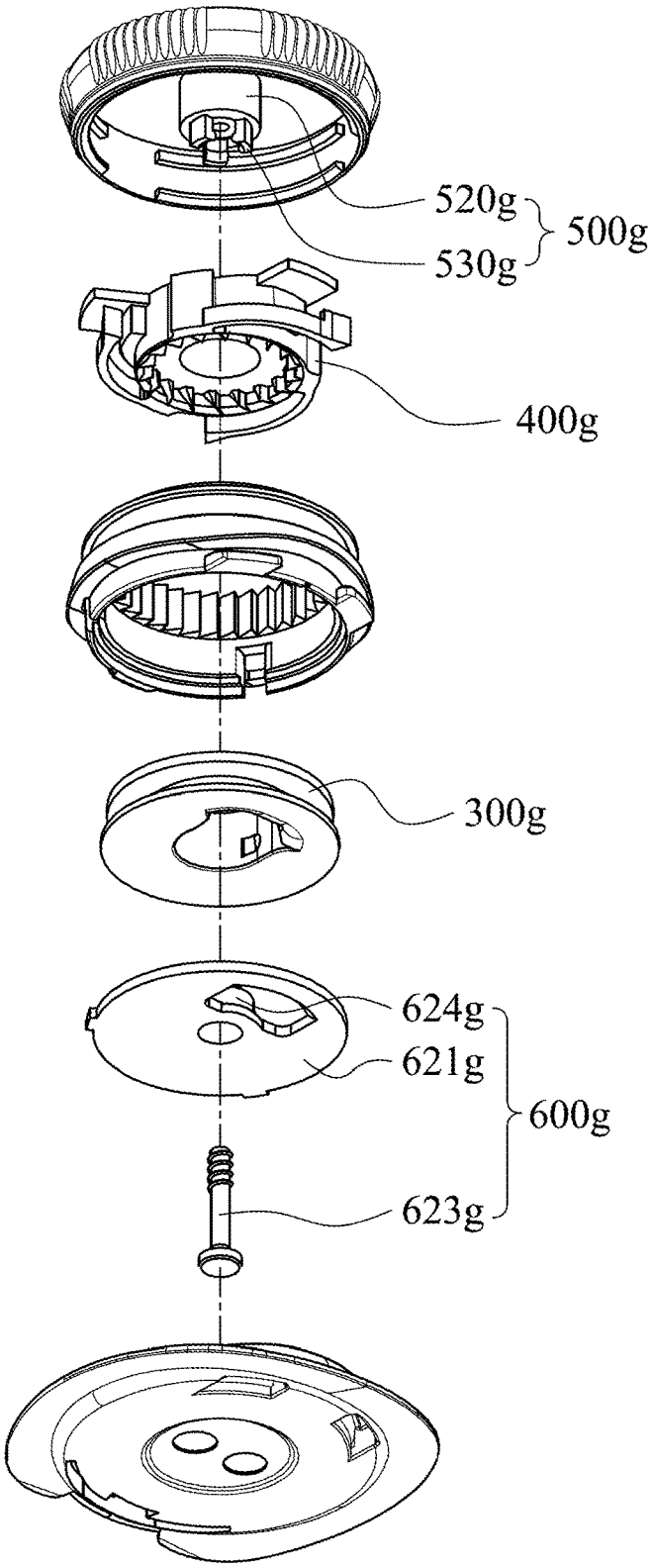
FIG. 20 shows another exploded view of the fastening device of FIG. 19.
Figure 21:
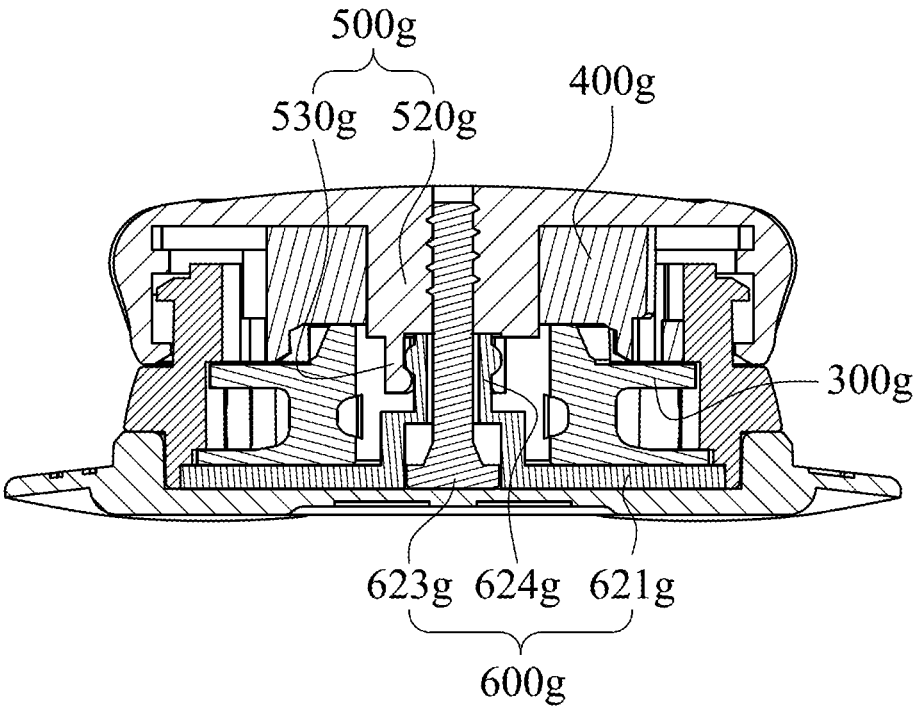
FIG. 21 shows a cross-sectional view of the fastening device of FIG. 19.

Please refer to FIG. 19, FIG. 20 and FIG. 21. FIG. 19 shows one exploded view of a fastening device 100*g* according to an eighth embodiment of the present disclosure, FIG. 20 shows another exploded view of the fastening device 100*g* of FIG. 19, and FIG. 21 shows a cross-sectional view of the fastening device 100*g* of FIG. 19. The fastening device 100*g* includes a case unit (its reference numeral is omitted), a spool 300*g*, a driving unit 400*g*, a knob 500*g* and a connecting unit 600*g*. The connecting unit 600*g* includes a plate 621*g*, a screw bar 623*g* and a plug 624*g*. The plug 624*g* protrudes upwardly from the plate 621*g*. The screw bar 623*g* is inserted from the plate 621*g* and the plug 624*g* to screw into a boss 520*g* of the knob 500*g*. The plug 624*g* can be coupled to three clamping arms 530*g* protruding from the boss 520*g*. When the knob 500*g* is pulled up, the driving unit 400*g* is lifted and the knob 500*f* is positioned by the plug 624*g*.

Figure 22:
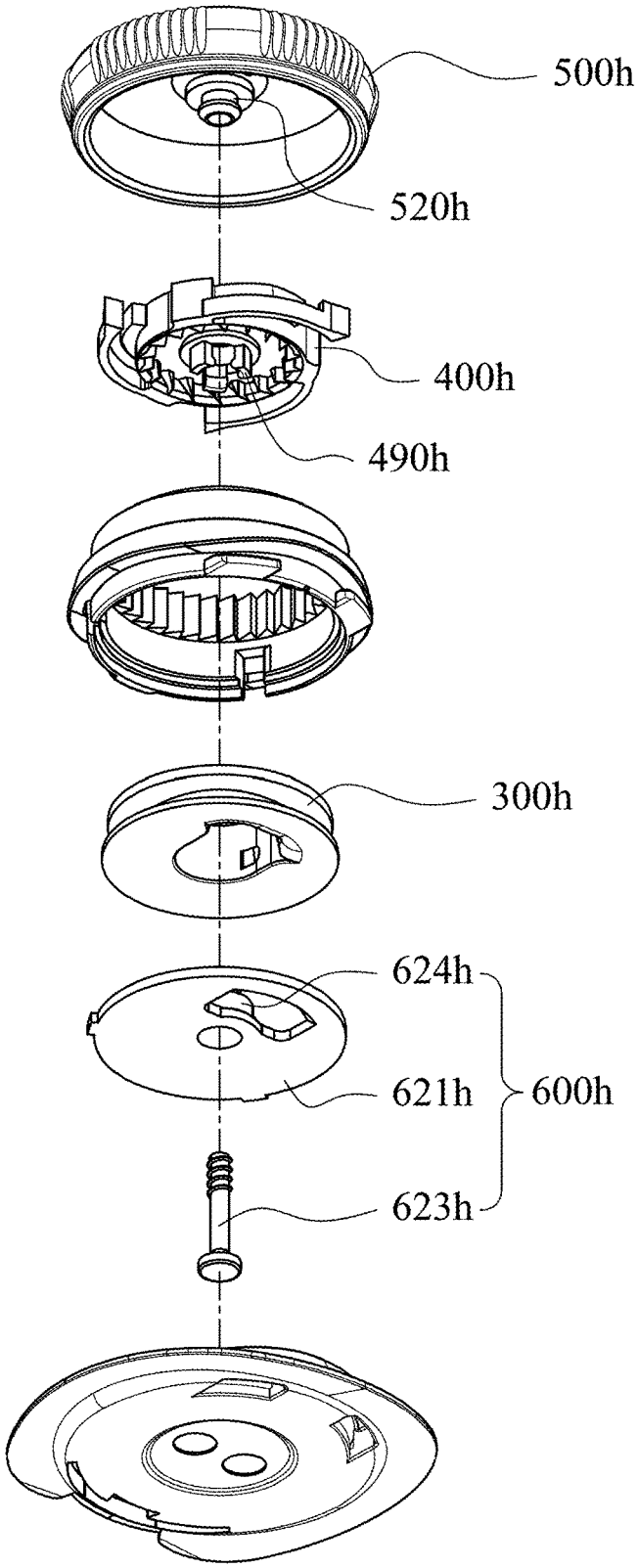
FIG. 22 shows an exploded view of a fastening device according to a ninth embodiment of the present disclosure.
Figure 23:
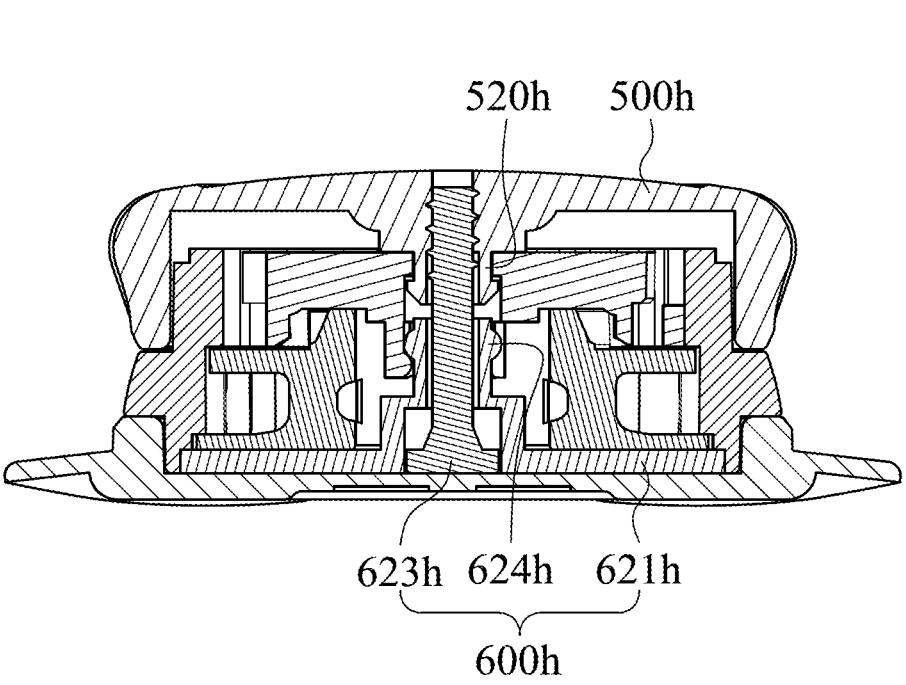
FIG. 23 shows a cross-sectional view of the fastening device of FIG. 22.

Please refer to FIG. 22 and FIG. 23. FIG. 22 shows an exploded view of a fastening device 100*h* according to a ninth embodiment of the present disclosure, and FIG. 23 shows a cross-sectional view of the fastening device 100*h* of FIG. 22. The fastening device 100*h* includes a case unit (its reference numeral is omitted), a spool 300*h*, a driving unit 400*h*, a knob 500*h* and a connecting unit 600*h*. The connecting unit 600*h* includes a plate 621*h*, a plug 624*h* and a screw bar 623*h*. The plug 624*h* protrudes from the plate 621*h*. The plug 624*h* is inserted into the central hole of the driving unit 400*h*, and three clamping arms 490*h* of the driving unit 400*h* are coupled to the plug 624*h*. The screw bar 623*h* passes through the plate 621*h* and the plug 624*h* to screw to the boss 520*h* of the knob 500*h*, and a head of the screw bar 623*h* is restricted by the plate 621*h*. The knob 500*h* can further include a lower flange located at a bottom end of the boss 520*h* and is restricted by the driving unit 400*h*. When the knob 500*h* is pulled up, the driving unit 400*h* is lifted and is positioned by the plug 624*h*.

Figure 24:
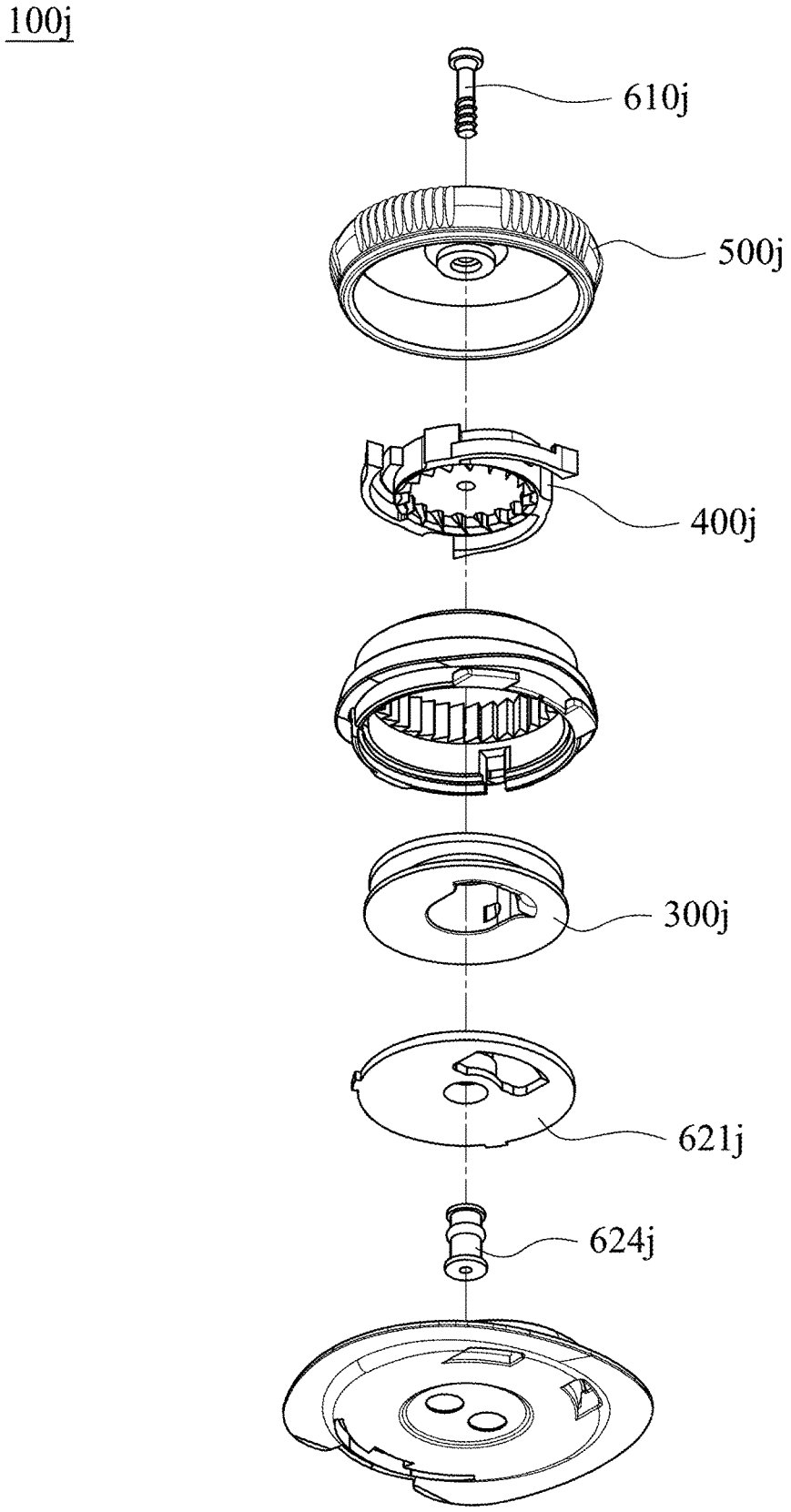
FIG. 24 shows an exploded view of a fastening device according to a tenth embodiment of the present disclosure.
Figure 25:
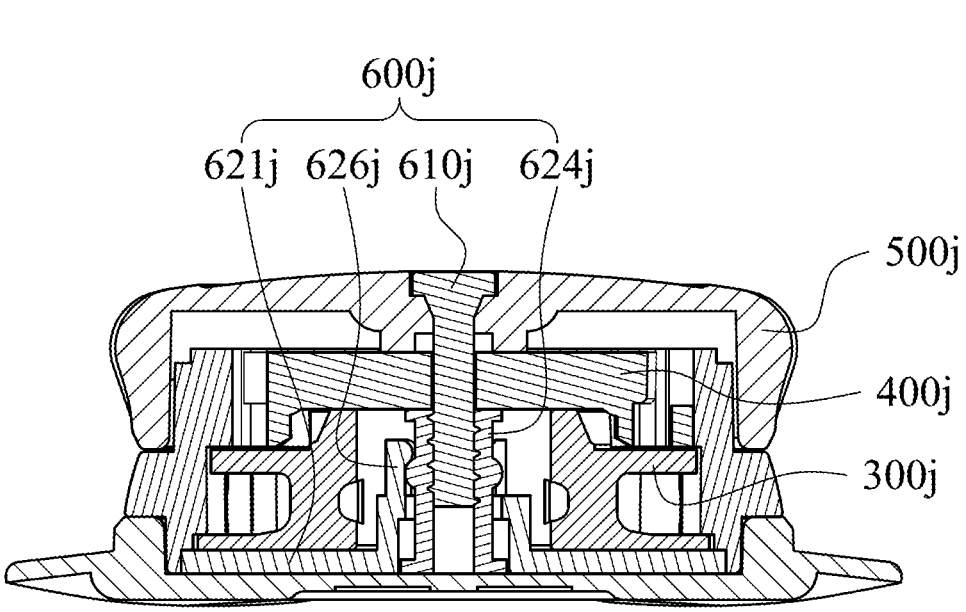
FIG. 25 shows a cross-sectional view of the fastening device of FIG. 24.

Please refer to FIG. 24 and FIG. 25. FIG. 24 shows an exploded view of a fastening device 100*j* according to a tenth embodiment of the present disclosure, and FIG. 25 shows a cross-sectional view of the fastening device 100*j* of FIG. 24. The fastening device 100*j* includes a case unit (its reference numeral is omitted), a spool 300*j*, a driving unit 400*j*, a knob 500*j* and a connecting unit 600*j*. The connecting unit 600*j* includes a screw bar 610*j*, a plate 621*j*, a plug 624*j* and three clamping projections 626*j*. The three clamping projections 626*j* protrude upwardly from the plate 621*j*. The plug 624*j* is inserted into the plate 621*j* to couple to the clamping protrusions 624*j*, and a top end surface of the plug 624*j* is abutted against the driving unit 400*j*. The screw bar 610*j* passes through the knob 500*j* to screw into the plug 624*j*, and the driving unit 400*j* is restricted between the knob 500*j* and the plug 624*j*. When the knob 500*j* is pulled up, the plug 624*j* is positioned by the clamping projections 626*j*.

Figure 26:
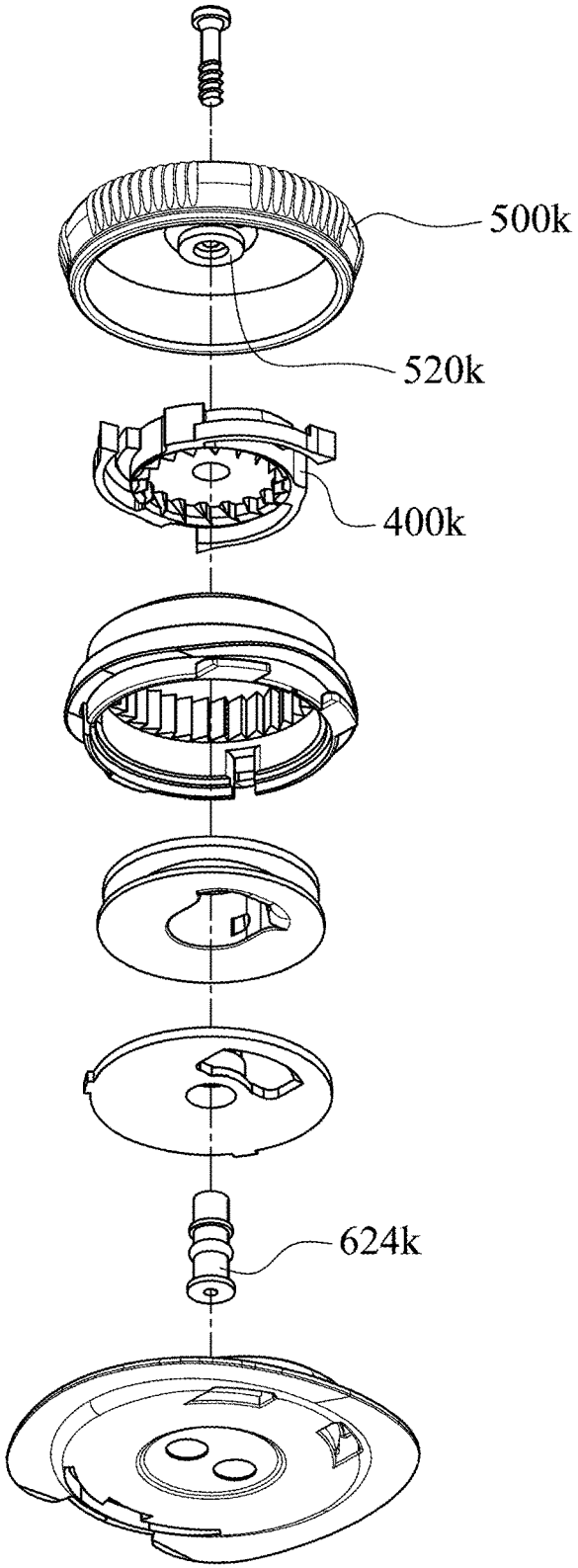
FIG. 26 shows an exploded view of a fastening device according to an eleventh embodiment of the present disclosure.
Figure 27:
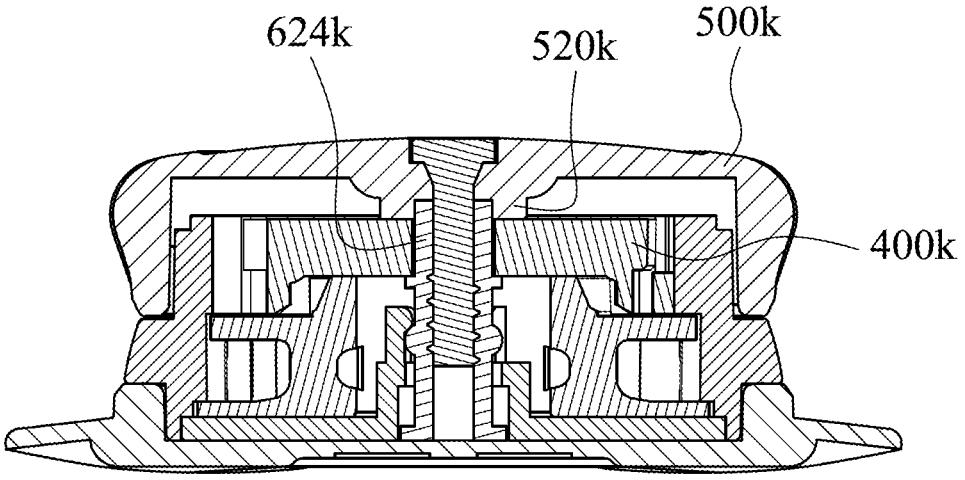
FIG. 27 shows a cross-sectional view of the fastening device of FIG. 26.

Please refer to FIG. 26 and FIG. 27. FIG. 26 shows an exploded view of a fastening device 100*k* according to an eleventh embodiment of the present disclosure, and FIG. 27 shows a cross-sectional view of the fastening device 100*k* of FIG. 26. The fastening device 100*k* is similar to the fastening device 100*j*, but the plug 624*k* is inserted into the boss 520*k* of the knob 500*k*, and a ledge of the plug 624*k* is abutted against the driving unit 400*k*.

Figure 28:
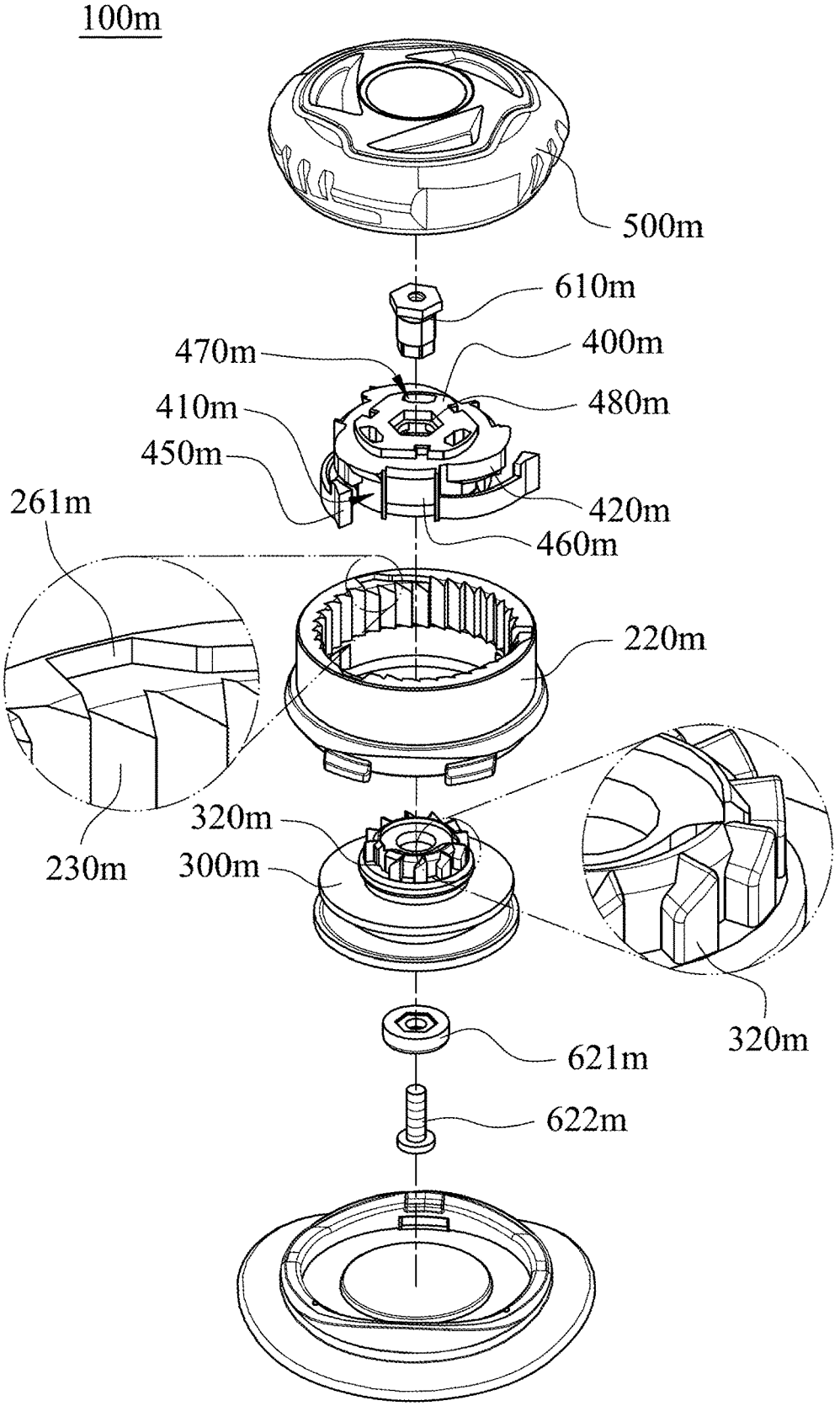
FIG. 28 shows one exploded view of a fastening device according to a twelfth embodiment of the present disclosure.
Figure 29:
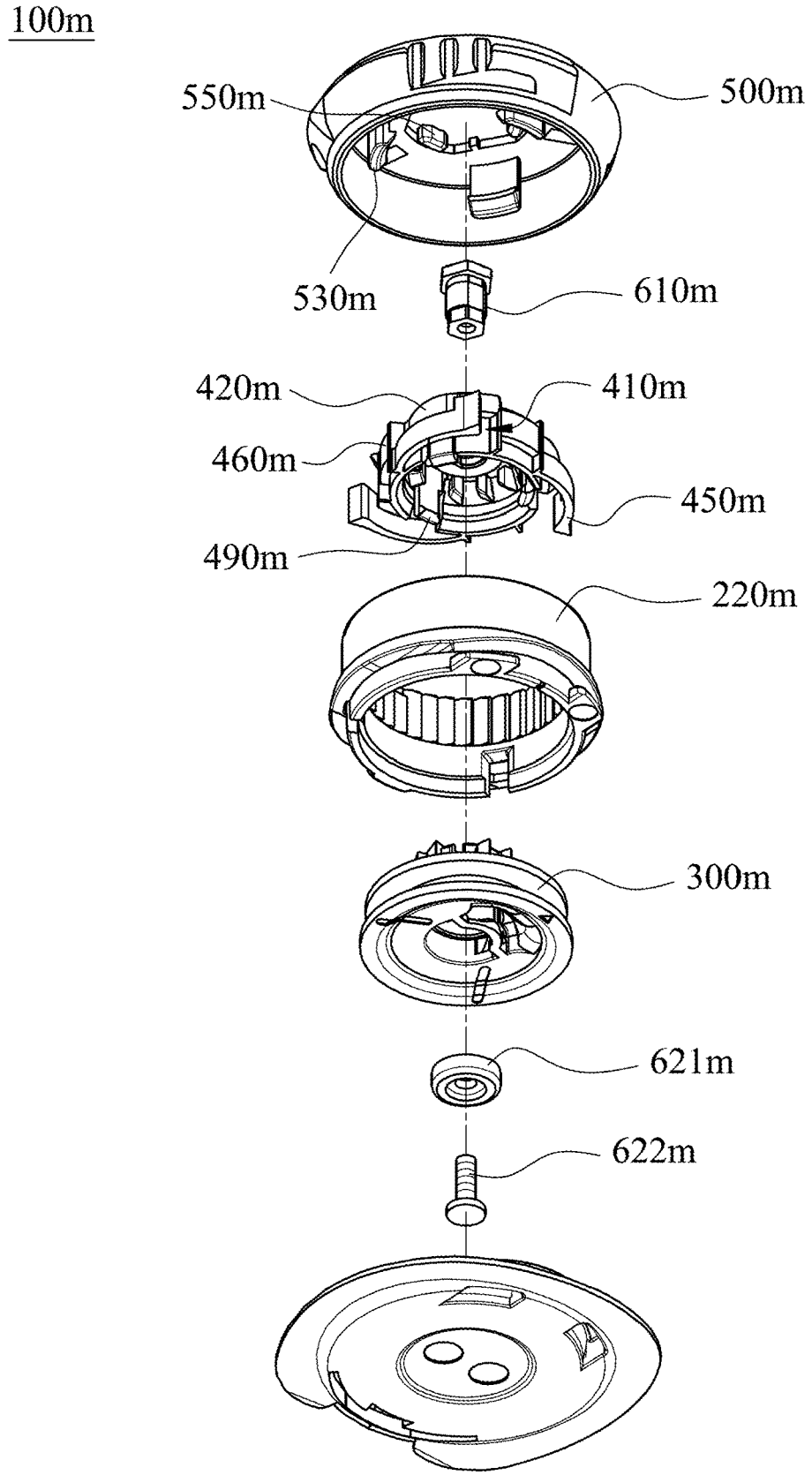
FIG. 29 shows another exploded view of the fastening device of FIG. 28.
Figure 30:
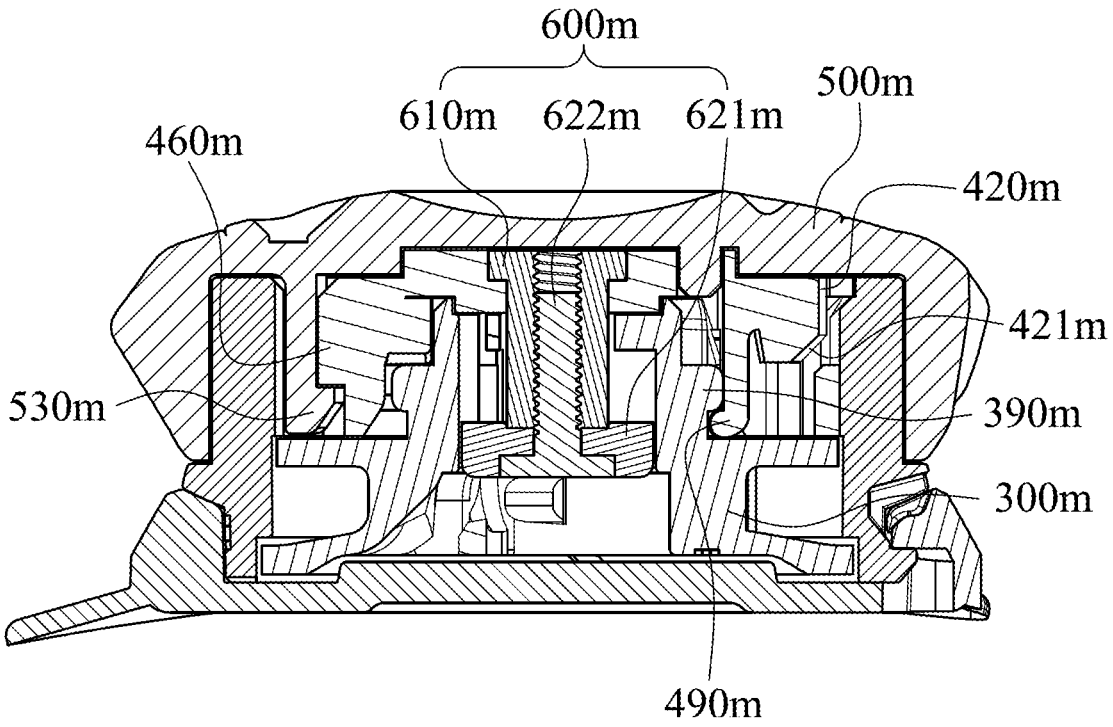
FIG. 30 shows a cross-sectional view of the fastening device of FIG. 28.

Please refer to FIG. 28, FIG. 29 and FIG. 30. FIG. 28 shows one exploded view of a fastening device 100*m* according to a twelfth embodiment of the present disclosure, FIG. 29 shows another exploded view of the fastening device 100*m* of FIG. 28, and FIG. 30 shows a cross-sectional view of the fastening device 100*m* of FIG. 28. The fastening device 100*m* includes a case unit (its reference numeral is omitted), a spool 300*m*, a driving unit 400*m*, a knob 500*m* and a connecting unit 600*m*. The connecting unit 600*m* includes a fastening barrel 610*m*, a stop ring 621*m* and a screw bar 622*m*. The driving unit 400*m* includes a central hole 480*m* which is shaped to fit the head of the fastening barrel 610*m*. The fastening barrel 610*m* is inserted downwardly into the axial space of the spool 300*m*, and the screw bar 622*m* passes through the stop ring 621*m* to screw into the fastening barrel 610*m* such that the stop ring 621*m* is abutted between the end surface of the fastening barrel 610*m* and the head portion of the screw bar 622*m*.

The spool 300*m* includes a plurality of engaging teeth 320*m*, and each of the engaging teeth 320*m* has a sloped segment. The driving unit 400*m* can further include three pawl arms 450*m*, three restricting blocks 420*m* and three restricting grooves 410*m*. Each of the pawl arms 450*m* corresponds to each of the restricting blocks 420*m* and is located therebelow. Each of the restricting blocks 420*m* includes a sloped surface 421*m*. Each of the restricting grooves 410*m* is adjacent to each of the restricting blocks 420*m*. When the pawl arm 450*m* is biased radially and inwardly, the pawl arm 450*m* is bended to allow a distal terminal of the pawl arm 450*m* to abut against the restricting block 420*m* to avoid over-bending of the pawl arm 450*m*.

As shown in FIGS. 28 to 30, the knob 500*m* includes three engaging arms 530*m* engaged with three engaging projections 460*m* of the driving unit 400*m*, respectively. The knob 500*m* further includes three positioning projections 550*m* inserting into three openings 470*m* of the driving unit 400*m*, respectively, and thus the driving unit 400*m* is coupled to the knob 500*m*. Moreover, the annular wall 220*m* includes three notches 261*m* located on the top surface of the annular wall 220*m*. Each of the notches 261*m* is adjacent to some of the mounting teeth 230*m*. The mounting tooth 230*m* which is near the notch 261*m* is cut and an inclined top surface is formed thereon. When the knob 500*m* is pulled upwardly, the driving unit 400*m* is lifted and the clamping arm 490*m* of the driving unit 400*m* is switched from the lower side of the positioning ring 390*m* of the spool 300*m* to the upper side of the positioning ring 390*m*. When the knob 500*m* is pressed downwardly and the driving unit 400*m* is lowered, the pawl arm 450*m* will engage with the mounting teeth 230*m* again. The pawl arm 450*m* will be biased radially and inwardly to go into the restricting groove 410*m* and will be guided by the notch 261*m* and the inclined top surfaces of the mounting teeth 230*m* to smoothly engage with the mounting teeth 230*m*. The sloped surface 421*m* of the restricting blocks 420*m* also facilitates smooth engagement between the mounting teeth 230*m* and the pawl arms 450*m*.

Figure 31:
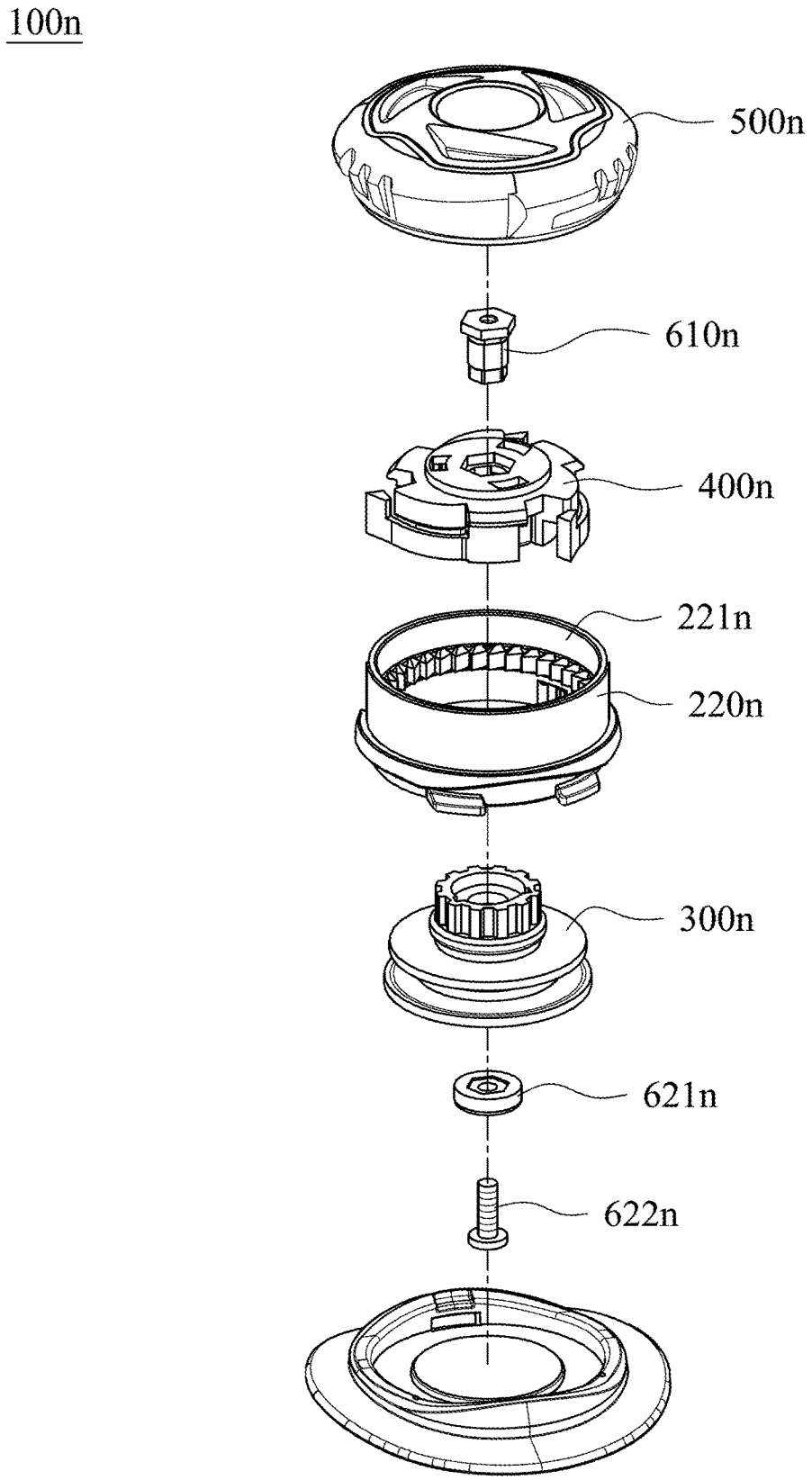
FIG. 31 shows an exploded view of a fastening device according to a thirteenth embodiment of the present disclosure.
Figure 32:
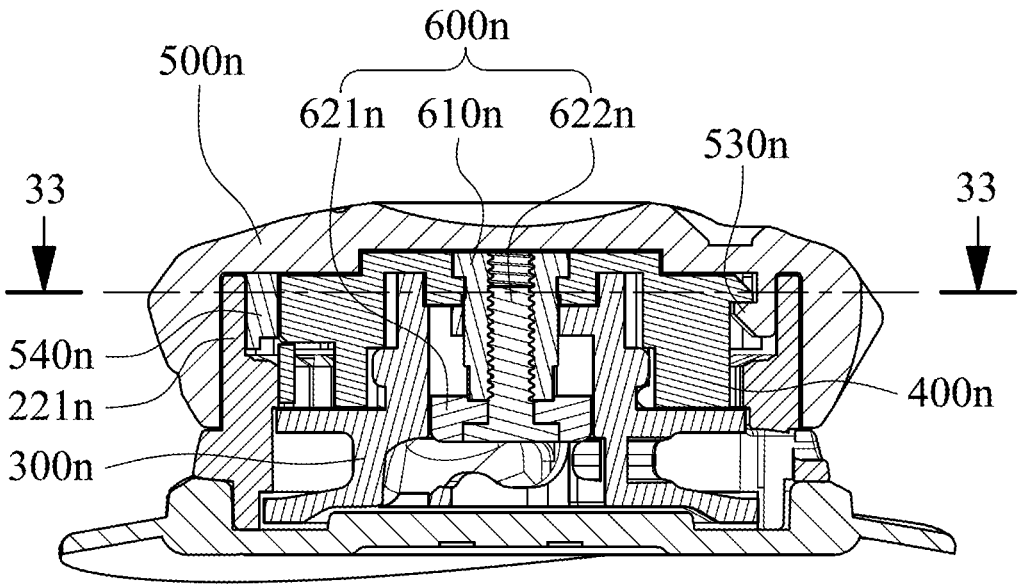
FIG. 32 shows a cross-sectional view of the fastening device of FIG. 31.
Figure 33:
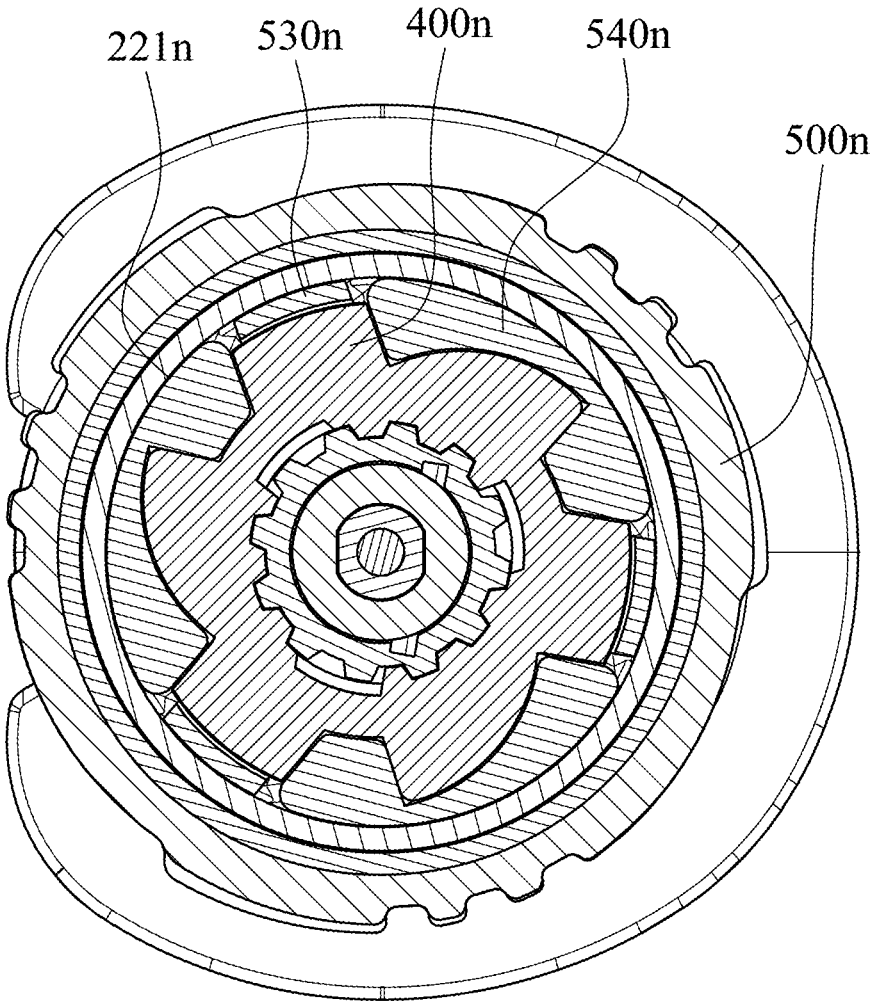
FIG. 33 shows a cross-sectional view of the fastening device of FIG. 32 taken along line 33-33.

Please refer to FIG. 31, FIG. 32 and FIG. 33. FIG. 31 shows an exploded view of a fastening device 100*n* according to a thirteenth embodiment of the present disclosure, FIG. 32 shows a cross-sectional view of the fastening device 100*n* of FIG. 31, and FIG. 33 shows a cross-sectional view of the fastening device 100*n* of FIG. 32 taken along line 33-33. The fastening device 100*n* includes a case unit (its reference numeral is omitted), a spool 300*n*, a driving unit 400*n*, a knob 500*n* and a connecting unit 600*n*. The connecting unit 600*n* includes a fastening barrel 610*n*, a stop ring 621*n* and a screw bar 622*n*. The fastening device 100*n* is similar to the fastening device 100*m*, but the annular wall 220*n* of the case unit can have a non-toothed upper portion 221*n*, and the gap between the non-toothed upper portion 221*n* and the driving unit 400*n* is used to accommodate the three engaging arms 530*n*. Moreover, the knob 500*n* can further include a plurality of abutting portions 540*n*, a top annular groove can be formed between the abutting portions 540*n* and the inner wall of knob 500*n*, and the non-toothed upper portion 221*n* can be inserted into the top annular groove. In addition, the abutting portions 540*n* are also shaped to fit the driving unit 400*n*. Through the configuration, the structure stability of the fastening device 100*n* can be increased.

Figure 34:
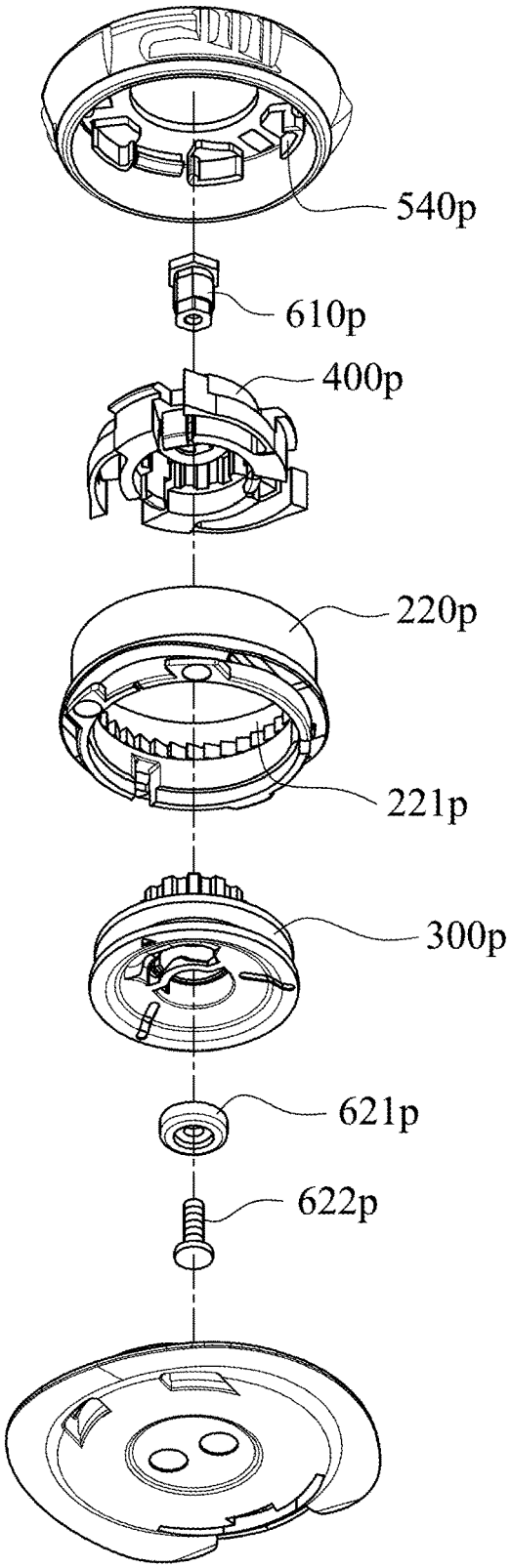
FIG. 34 shows an exploded view of a fastening device according to a fourteenth embodiment of the present disclosure.
Figure 35:
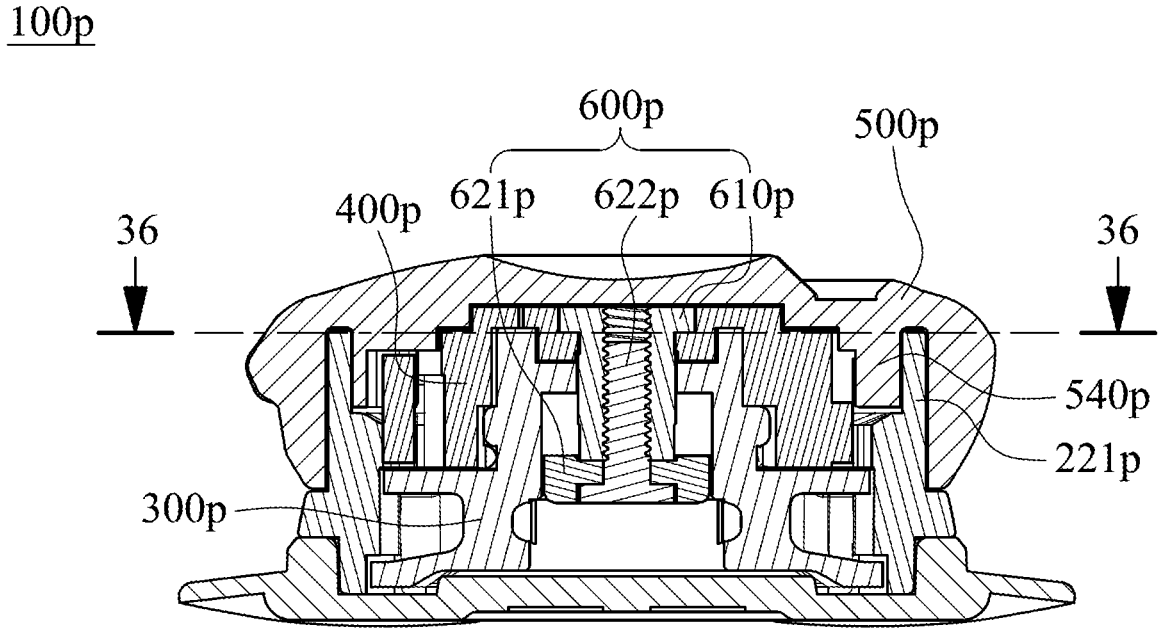
FIG. 35 shows a cross-sectional view of the fastening device of FIG. 34.
Figure 36:
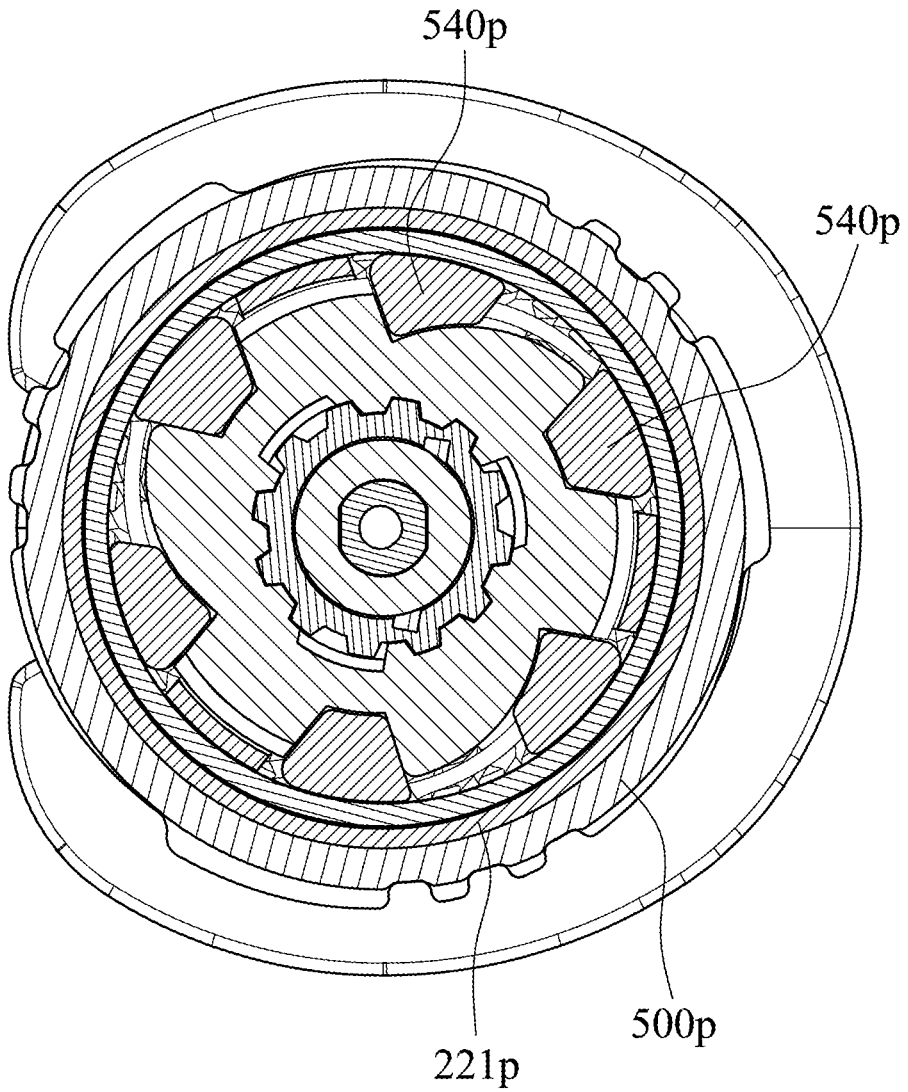
FIG. 36 shows a cross-sectional view of the fastening device of FIG. 35 taken along line 36-36.

Please refer to FIG. 34, FIG. 35 and FIG. 36. FIG. 34 shows an exploded view of a fastening device 100*p* according to a fourteenth embodiment of the present disclosure, FIG. 35 shows a cross-sectional view of the fastening device 100*p* of FIG. 34, and FIG. 36 shows a cross-sectional view of the fastening device 100*p* of FIG. 35 taken along line 36-36. The fastening device 100*p* includes a case unit (its reference numeral is omitted), a spool 300*p*, a driving unit 400*p*, a knob 500*p* and a connecting unit 600*p*. The connecting unit 600*p* includes a fastening barrel 610*p*, a stop ring 621*p* and a screw bar 622*p*. The fastening device 100*p* is similar to the fastening device 100*n*, the annular wall 220*p* of the case unit has a non-toothed upper portion 221*p*, and the knob 500*p* can include a plurality of abutting portions 540*p*. However, a number of the abutting portions 540*p* and the shapes of the abutting portions 540*p* are different from those of the abutting portions 540*n*.

Figure 37:
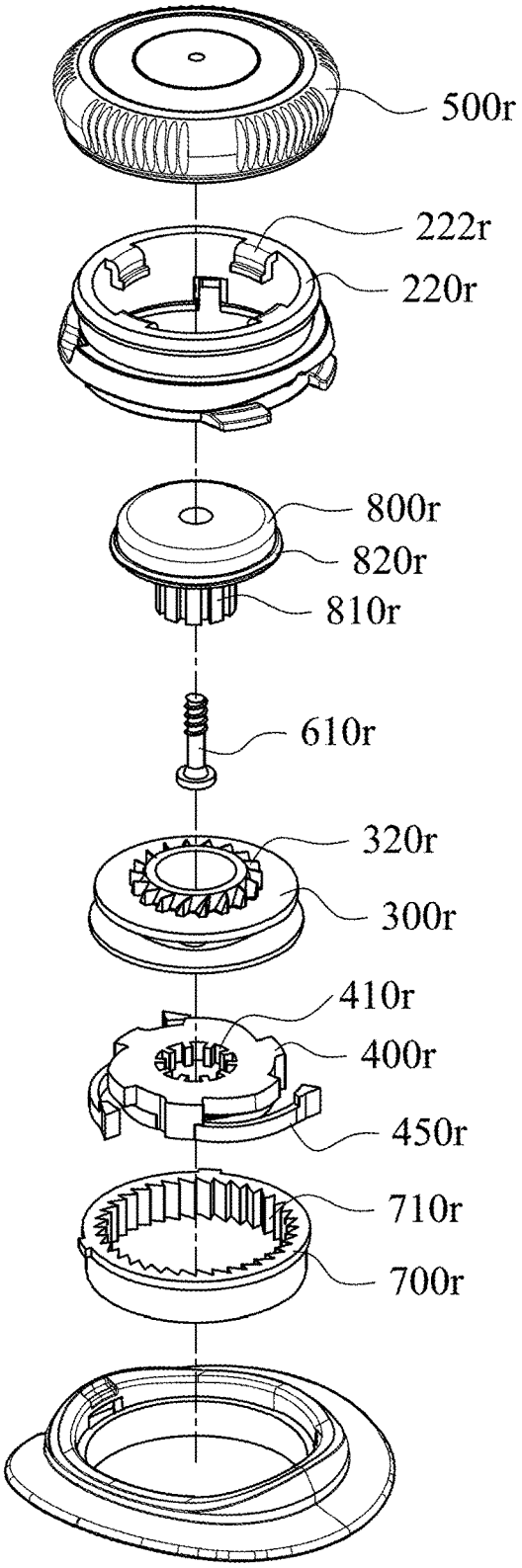
FIG. 37 shows an exploded view of a fastening device according to a fifteenth embodiment of the present disclosure.
Figure 38:
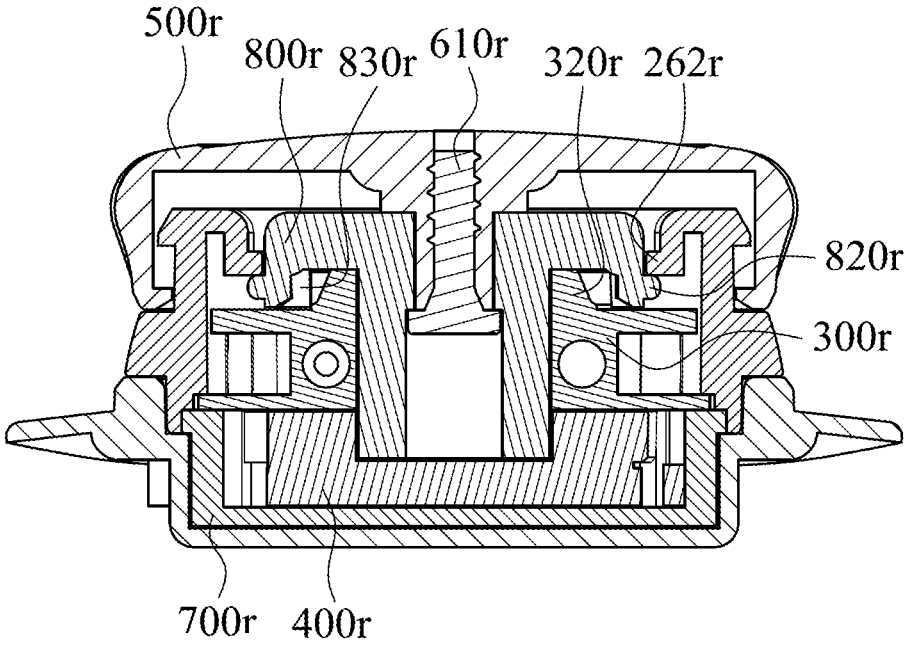
FIG. 38 shows a cross-sectional view of the fastening device of FIG. 37.

Please refer to FIG. 37 and FIG. 38. FIG. 37 shows an exploded view of a fastening device 100*r* according to a fifteenth embodiment of the present disclosure, and FIG. 38 shows a cross-sectional view of the fastening device 100*r* of FIG. 37. The fastening device 100*r* includes a case unit (its reference numeral is omitted), a spool 300*r*, a driving unit 400*r*, a knob 500*r*, a coupling member 800*r*, a ratchet gear 700*r* and a connecting unit (its reference numeral is omitted).

The annular wall 220*r* of the case unit can include four radial projections 222*r*. The coupling member 800*r* can include a coupling ring 820*r* correspondent to the radial projections 222*r*. The driving unit 400*r* is located below the spool 300*r* and includes three pawl arms 450*r* selectively engaged with the mounting teeth 710*r* of the ratchet gear 700*r*. The coupling member 800*r* further includes a plurality of the inner teeth 830*r* engaged with the engaging teeth 320*r* of the spool 300*r*. The coupling member 800*r* can pass through the spool 300*r* to allow a plurality of first coupling teeth 810*r* to engage with a plurality of second coupling teeth 410*r* of the driving unit 400*r*. The connecting unit is composed of the screw bar 610*r*. The screw bar 610*r* is inserted into the coupling member 800*r* to screw with the knob 500*r*, and a head of the screw bar 610*r* is restricted by the coupling member 800*r*. When the knob 500*r* is pulled up, the coupling member 800*r* is lifted and the inner teeth 830*r* are disengaged from the engaging teeth 320*r*; as a result, the spool 300*r* is not restricted and can rotate freely.

Figure 39:
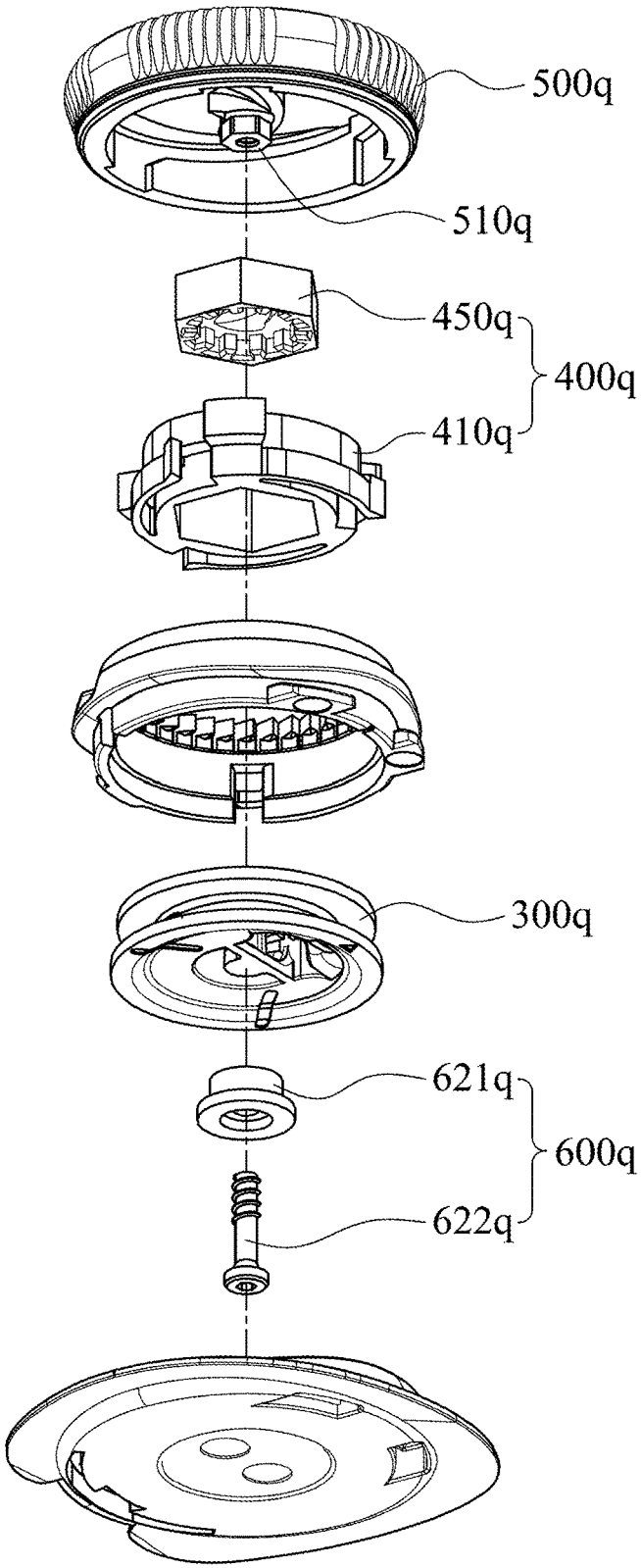
FIG. 39 shows an exploded view of a fastening device according to a sixteenth embodiment of the present disclosure.
Figure 40:
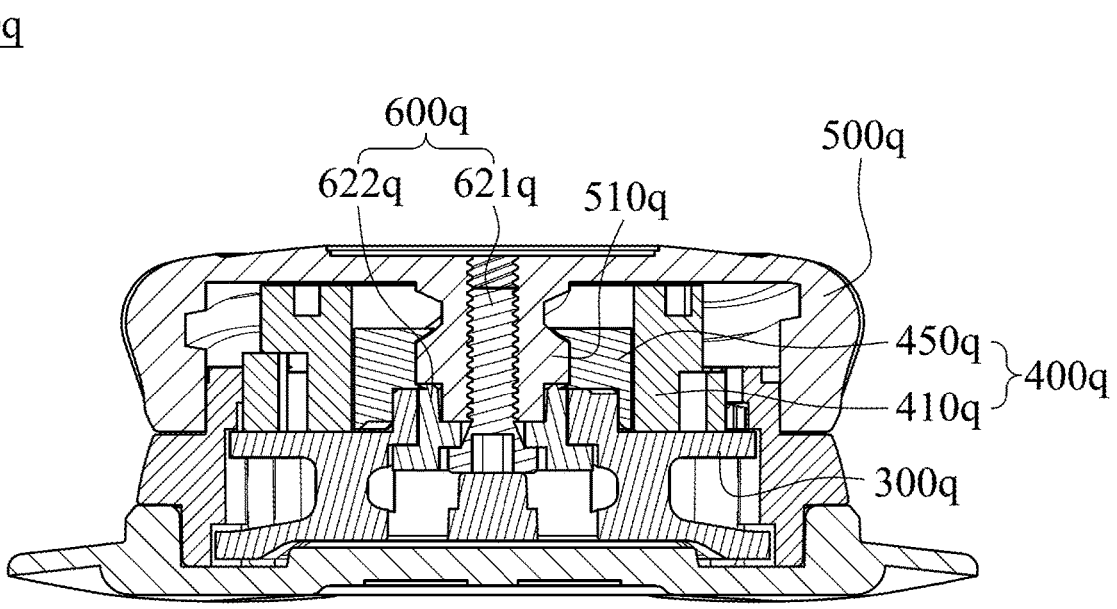
FIG. 40 shows a cross-sectional view of the fastening device of FIG. 39.

Please refer to FIG. 39 and FIG. 40. FIG. 39 shows an exploded view of a fastening device 100*q* according to a sixteenth embodiment of the present disclosure, and FIG. 40 shows a cross-sectional view of the fastening device 100*q* of FIG. 39. The fastening device 100*q* includes a case unit (its reference numeral is omitted), a spool 300*q*, a driving unit 400*q*, a knob 500*q* and a connecting unit 600*q*.

The driving unit 400*q* includes an engaging disc 410*q* and an inner gear 450*q* movable within the engaging disc 410*q*. The inner gear 450*q* can couple to the spool 300*q*. The knob 500*q* includes a screw post 510*q* engaged with the screw hole of the inner gear 450*q*. When the knob 500*q* is forced in the loosening direction, the inner gear 450*q* is lifted owing to the structure of the screw post 510*q* and the screw hole, and the inner gear 450*q* can be separated from the spool 300*q*. The connecting unit 600*q* includes a stop ring 621*q* and a screw bar 622*q*. The screw bar 622*q* passes through the stop ring 621*q* to screw into the screw post 510*q* such that the stop ring 621*q* is abutted between the end surface of the screw post 510*q* and the head portion of the screw bar 622*q*.

Figure 41:
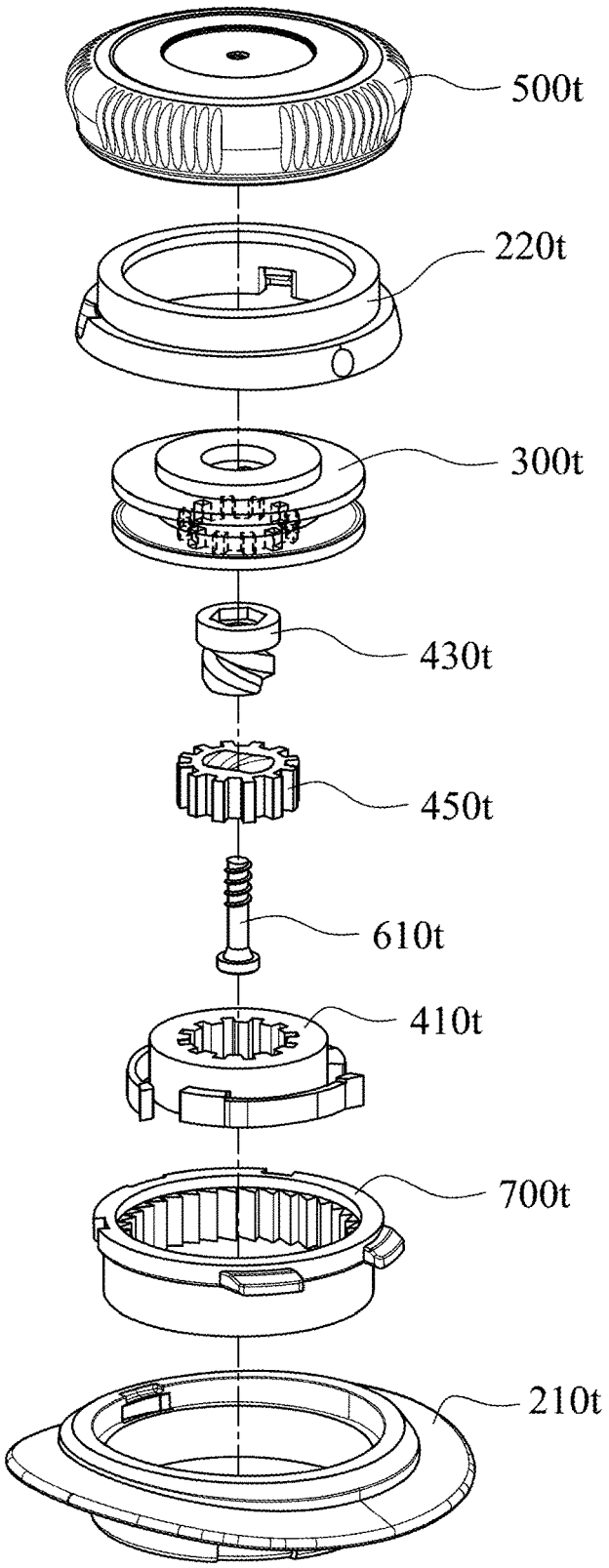
FIG. 41 shows an exploded view of a fastening device according to a seventeenth embodiment of the present disclosure.
Figure 42:
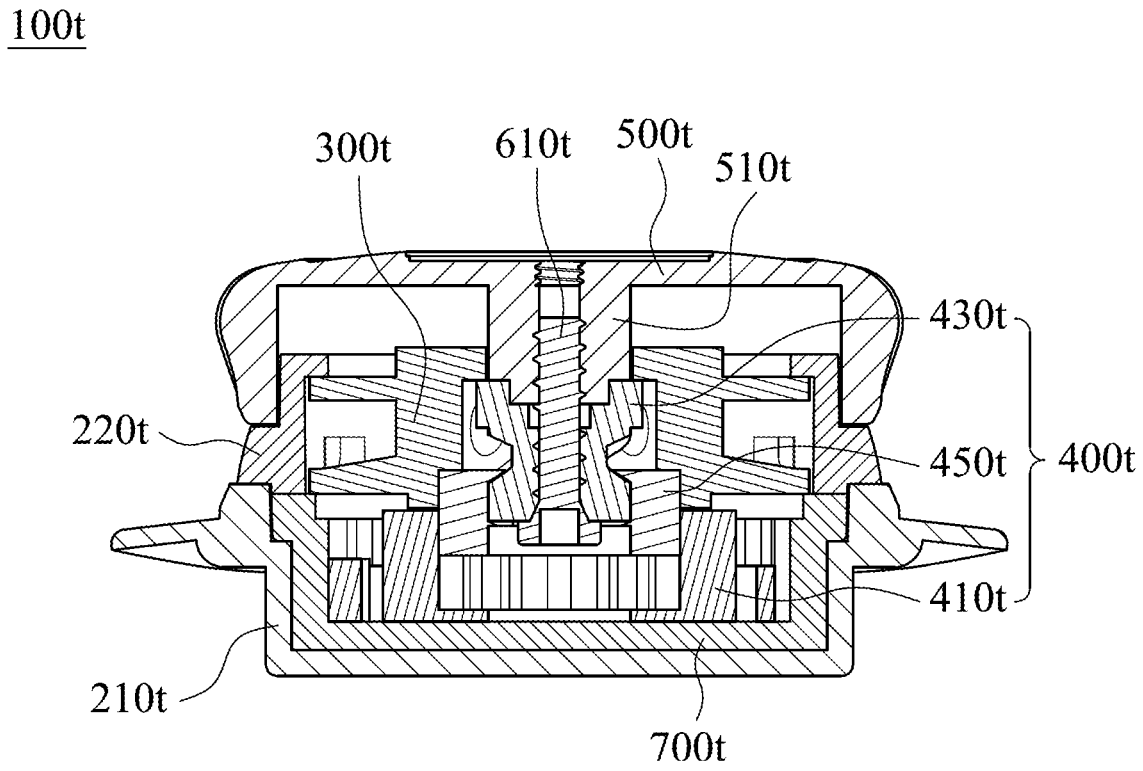
FIG. 42 shows a cross-sectional view of the fastening device of FIG. 41.

Please refer to FIG. 41 and FIG. 42. FIG. 41 shows an exploded view of a fastening device 100*t* according to a seventeenth embodiment of the present disclosure, and FIG. 42 shows a cross-sectional view of the fastening device 100*t* of FIG. 41. The fastening device 100*t* includes a case unit (its reference numeral is omitted), a spool 300*t*, a driving unit 400*t*, a knob 500*t*, a ratchet gear 700*t* and a connecting unit (its reference numeral is omitted). The driving unit 400*t* includes an engaging disc 410*t*, an inner gear 450*t* and a screw post 430*t*. The inner gear 450*t* is movable within the engaging disc 410*t* and is coupled to the spool 300*t*. The screw post 430*t* is coupled to the inner gear 450*t*. The engaging disc 410*t* and the ratchet gear 700*t* are located below the spool 300*t*. The case unit includes a base 210*t* and an annular wall 220*t*, and the base 210*t* is deep enough to receive the ratchet gear 700*t* and the engaging disc 410*t*. The connecting unit is composed of a screw bar 610*t* which can be inserted into the screw post 430*t* to screw with the boss 510*t* of the knob 500*t*. Hence, when the knob 500*t* is rotated in the loosening direction, the inner gear 450*t* will be guided by the screw post 430*t* to be lifted and will disengage from the engaging disc 410*t*.

Figure 43:
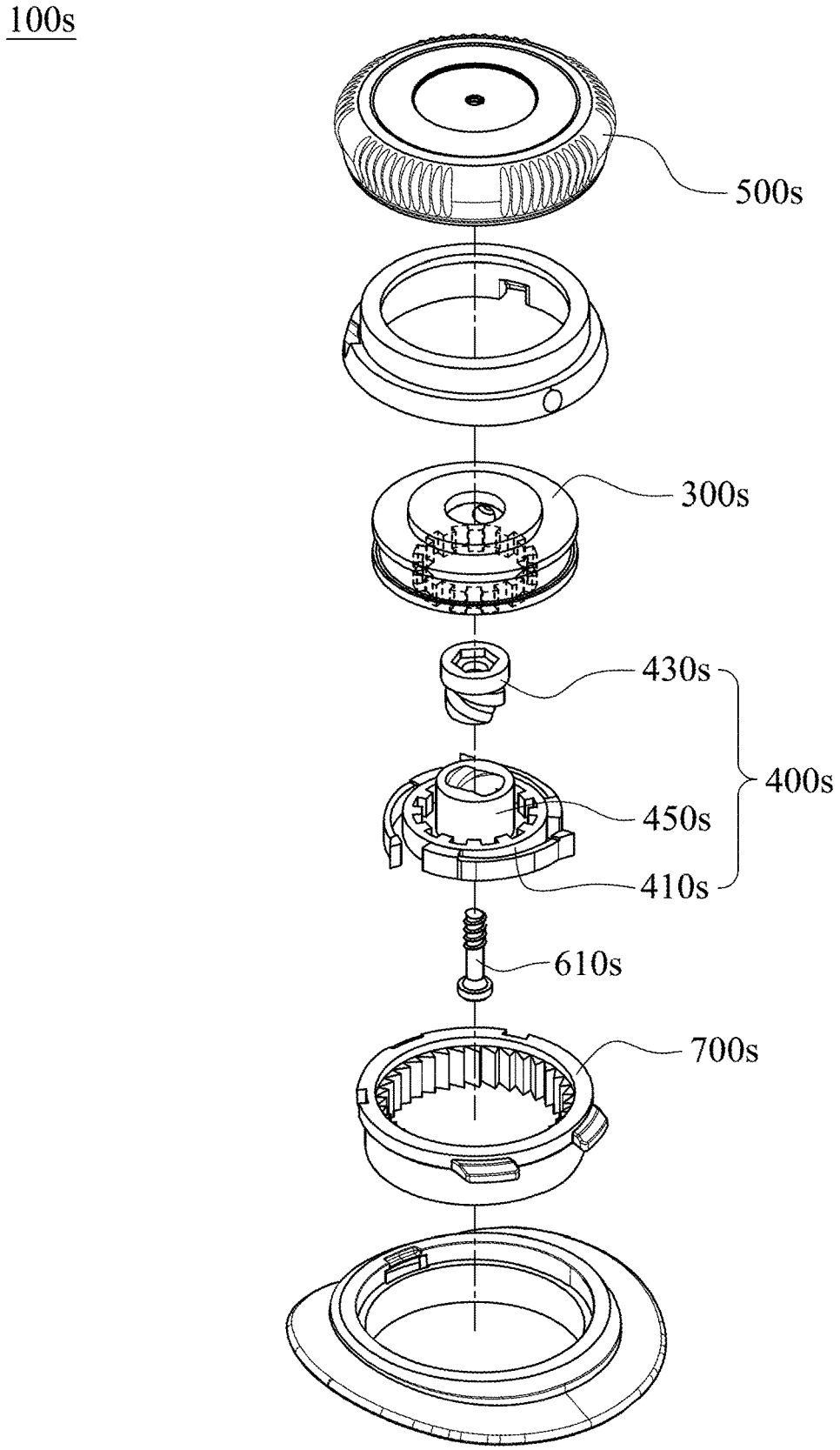
FIG. 43 shows an exploded view of a fastening device according to an eighteenth embodiment of the present disclosure.
Figure 44:
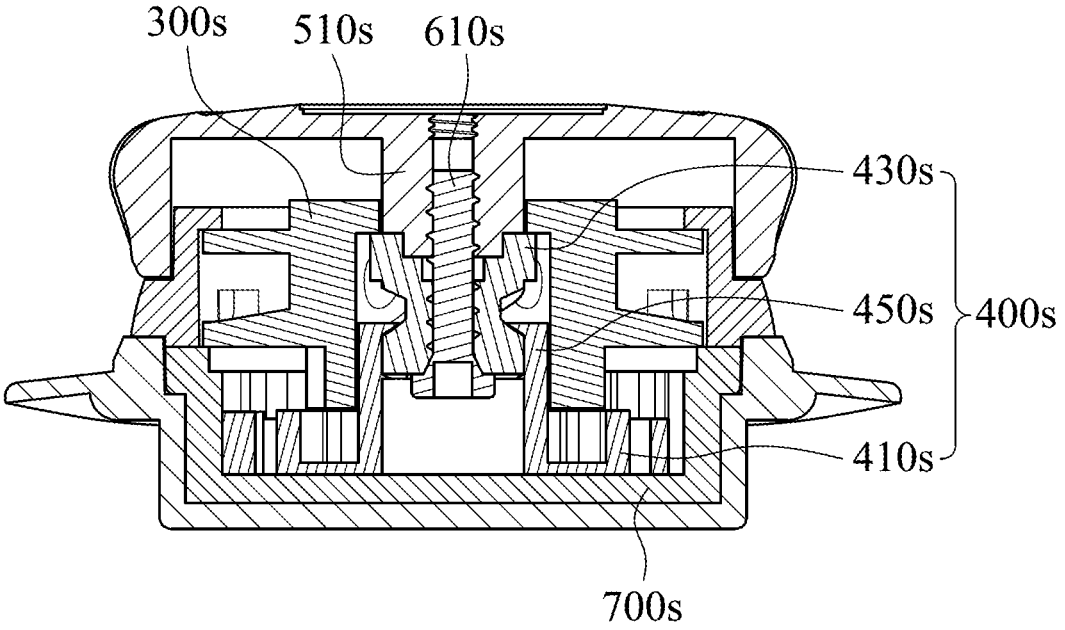
FIG. 44 shows a cross-sectional view of the fastening device of FIG. 43.

Please refer to FIG. 43 and FIG. 44. FIG. 43 shows an exploded view of a fastening device 100*s* according to an eighteenth embodiment of the present disclosure, and FIG. 44 shows a cross-sectional view of the fastening device 100*s* of FIG. 43. The fastening device 100*s* includes a case unit (its reference numeral is omitted), a spool 300*s*, a driving unit 400*s*, a knob 500*s*, a ratchet gear 700*s* and a connecting unit (its reference numeral is omitted). The driving unit 400*s* includes a screw barrel 450*s*, an engaging disc 410*s* and a screw post 430*s*. The screw barrel 450*s* is integrally formed with the engaging disc 410*s* and protrudes upward from the engaging disc 410*s* into the axial space of the spool 300*s*. The screw post 430*s* is coupled to the screw barrel 450*s*. The connecting unit is composed of a screw bar 610*s* which can be inserted into the screw post 430*s* to screw with the boss 510*s* of the knob 500*s*. Hence, when the knob 500*s* is rotated in the loosening direction, the engaging disc 410*s* and the screw barrel 450*s* will be guided by the screw post 430*s* to be lowered and the engaging disc 410*s* will disengage from the spool 300*s*.

Figure 45:
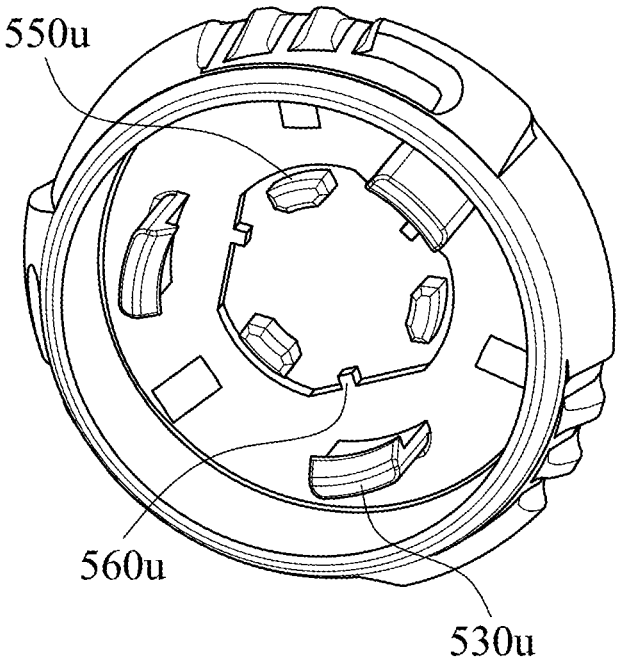
FIG. 45 shows a three-dimensional schematic view of a knob of a fastening device according to a nineteenth embodiment of the present disclosure.
Figure 46:
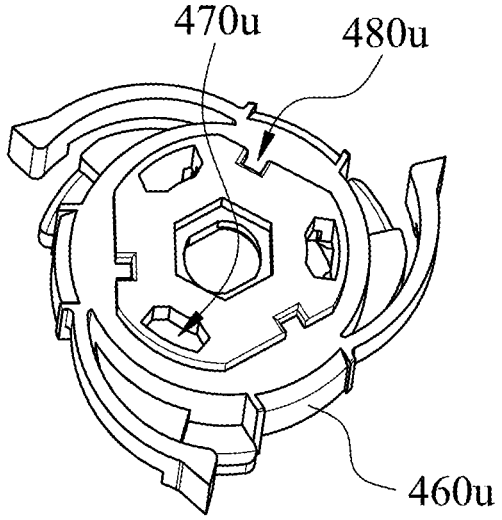
FIG. 46 shows a three-dimensional schematic view of a driving unit of the fastening device of FIG. 45.

Please refer to FIG. 45 and FIG. 46. FIG. 45 shows a three-dimensional schematic view of a knob 500*u* of a fastening device according to a nineteenth embodiment of the present disclosure, and FIG. 46 shows a three-dimensional schematic view of a driving unit 400*u* of the fastening device of FIG. 45. The fastening device of the nineteenth embodiment is similar to the fastening device 100*m* of the twelfth embodiment shown in FIGS. 28 to 30. The knob 500*u* can includes three engaging arms 530*u* engaged with at three engaging projections 460*u* of the driving unit 400*u*.

The knob 500*u* further includes three positioning projections 550*u* inserting into three openings 470*u* of the driving unit 400*u*, respectively. Moreover, the knob 500*u* can further include three radial tabs 560*u* engaged with three radial grooves 480*u* of the driving unit 400*u*, respectively. Thus, the driving unit 400*u* is coupled to the knob 500*u*, and a rotating force of the knob 500*u* can be efficiently transmitted to the driving unit 400*u*.

Although the invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the invention without departing from the scope or spirit of the disclosure. In view of the foregoing, it is intended that the invention covers modifications and variations of this disclosure provided they fall within the scope of the following claims.

What is claimed is:

1. A fastening device, comprising:

a case unit, comprising:

an annular wall surrounding an inner space, the annular wall comprising an upper opening communicated with the inner space, and a bottom opening opposite to the upper opening and communicated with the inner space; and a base below the annular wall and detachably and directly coupled to the annular wall, the base being coupled to the annular wall by engagement such that the annular wall does not rotate relative to the base;

a spool located within the inner space for a lace to be wound thereabout;

a driving unit located within the inner space and selectively prohibiting the spool from rotating in a loosening direction;

a knob disposed on the annular wall; and a connecting unit connected to the knob and axially restricted by the spool;

wherein the knob is not moved along an axial direction to release the lace.

2. The fastening device of claim 1, wherein the case unit further comprises an inner annular groove located at the annular wall, and a lower annular portion of the spool is received in the inner annular groove.

3. The fastening device of claim 1, wherein the connecting unit further comprises:

a screw bar connected to the knob; and a connecting barrel, comprising a top portion and a barrel body portion, wherein the barrel body portion is connected to the top portion, the barrel body portion passes through a small-diameter segment of the spool and is screwed with the screw bar, the top portion is limited within a large-diameter segment of the spool.

4. The fastening device of claim 1, wherein the spool comprises an upper annular portion and a lower annular portion for forming an annular track, and a diameter of the upper annular portion is smaller than a diameter of the bottom opening.

* * * * *